US006144350A

United States Patent [19]

Fujii et al.

[11] Patent Number: 6,144,350

[45] **Date of Patent: *Nov. 7, 2000**

[54] ELECTRON GENERATING APPARATUS, IMAGE FORMING APPARATUS, AND METHOD OF MANUFACTURING AND ADJUSTING THE SAME

[75] Inventors: Akira Fujii, Yokohama; Hidetoshi Suzuki, Fujisawa; Eiji Yamaguchi, Zama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/731,506

[22] Filed: Oct. 16, 1996

[30] Foreign Application Priority Data

Jan. 16, 1996 [JP] Japan ..... 8-004834
Oct. 3, 1996 [JP] Japan ..... 8-263068

[51] Int. Cl.[7] ..... G09G 3/22

[52] U.S. Cl. ..... 345/74; 345/55; 438/26

[58] Field of Search ..... 345/65, 76, 77, 345/78, 79, 74, 94, 97, 212, 56, 58, 61, 80, 55; 438/26

[56] References Cited

U.S. PATENT DOCUMENTS

| | | | |
|---|---|---|---|
| 5,063,538 | 11/1991 | Kuehnle | 365/106 |
| 5,066,883 | 11/1991 | Yoshioka et al. | 313/309 |
| 5,175,535 | 12/1992 | Yamazaki et al. | 340/784 |
| 5,593,335 | 1/1997 | Suzuki et al. | 445/50 |
| 5,650,795 | 7/1997 | Banno et al. | 345/74 |
| 5,659,329 | 8/1997 | Yamanobe et al. | 345/74 |

FOREIGN PATENT DOCUMENTS

| | | | |
|---|---|---|---|
| 0651418 | 5/1995 | European Pat. Off. . | |
| 64-31332 | 2/1989 | Japan . | |
| 2257551 | 10/1990 | Japan . | |
| 3-81937 | 4/1991 | Japan | 31/12 |
| 428137 | 1/1992 | Japan . | |
| 4-249827 | 9/1992 | Japan . | |
| 7094103 | 4/1995 | Japan . | |

OTHER PUBLICATIONS

Argument Submission Notice. Application No. 10–1996–0047598 (translation), Feb. 26, 1999.

Araki, H., et al. "electroforming and Electron Emission of Carbon Thin Films", Journal of the Vacuum Society of Japan, vol. 26, No. 1, pp. 22–29, Sep., 1981.

Dittmer, G., "Electrical Conduction and Electron Emission of Discontinuous Thin Films", Thin Solid Films, pp. 317–328, Jul., 1871.

(List continued on next page.)

*Primary Examiner*—Mark K. Zimmerman
*Assistant Examiner*—Thu Nguyen
*Attorney, Agent, or Firm*—Fitzpatrick, Cella, Harper & Scinto

[57] ABSTRACT

It is an object of this invention to provide an electron generating apparatus which is hardly influenced by variations in driving voltage, an image forming apparatus using the electron generating apparatus, and a method of manufacturing and adjusting the same. The row wiring layers of a multi-electron-beam source (300) are sequentially selectively switched by a control circuit (302) and applied with a pulse voltage having a value about 1.05 to 1.5 times the maximum value of a normal driving voltage from a DC voltage source (301). The characteristics of all surface conduction electron-emitting devices of the multi-electron-beam source (300) are shifted to the high potential side. With this process, even when the driving voltage becomes high due to superposition of noise and the driving voltage, variations in electron-emitting characteristics caused by the voltage shift characteristics of the surface conduction electron-emitting devices can be prevented.

24 Claims, 25 Drawing Sheets

OTHER PUBLICATIONS

Dyke, W.P., et al., "Field Emission", Advances in Electronics and Electron Physics, Academic Press, New York, NY, vol. III, pp. 90–185, 1956.

Elimson, M.I., et al., "The Emission of Hot Electrons and The Field Emission of Electrons from Tin Oxide", Radio Engineering and Electronic Physics, pp. 1290–1296, Jul., 1965.

Hartwell, M., et al., "Strong Electron Emission From Patterned Tin–Indium Oxide Thin Films", International Electron Devices Meeting, Washington, D.C., pp. 519–521, 1975.

Mead, C.A., "Operation of Tunnel–Emission Devices", Journal of Applied Physics, vol. 32, No. 4, pp. 646–652, Apr. 1961.

Spindt, C.A., et al., "Physical Properties of Thin–Film Field Emission Cathodes with Molybdenum Cones", Journal of Applied Physics, vol. 47, No. 12, pp. 5248–5263, Jul., 1976.

ELECTRON GENERATING APPARATUS, IMAGE FORMING APPARATUS, AND METHOD OF MANUFACTURING AND ADJUSTING THE SAME

BACKGROUND OF THE INVENTION

1. Field of the Invention

The present invention relates to an electron generating apparatus in which a plurality of surface conduction electron-emitting devices are arranged, an image forming apparatus using the electron generating apparatus, and a method of manufacturing and adjusting the same.

2. Related Background Art

Conventionally, two types of devices, namely thermionic and cold cathode devices, are known as electron-emitting devices. Examples of cold cathode devices are surface conduction electron-emitting devices, field emission type devices (to be referred to as FE type devices hereinafter), and metal/insulator/metal type emission devices (to be referred to as MIM type devices hereinafter).

Known examples of the FE type devices are described in W. P. Dyke and W. W. Dolan, "Field Emission", Advance in Electron Physics, 8,89 (1956) and C. A. Spindt, "Physical properties of thin-film field emission cathodes with molybdenum cones", J. Appl. Phys., 47,5248 (1976).

A known example of the MIM type devices is described in C. A. Mead, "Operation of Tunnel-emission Devices", J. Appl. Phys., 32,646 (1961).

A known example of the surface conduction electrone-mitting devices is described in, e.g., M. I. Elinson, Radio. Eng. Electron Phys., 10, 1290 (1965) and other examples to be described later.

The surface conduction electron-emitting device utilizes the phenomenon that electron emission is caused in a small-area thin film, formed on a substrate, by passing a current parallel to the film surface. The surface conduction electron-emitting device includes devices using an Au thin film (G. Dittmer, "Thin Solid Films", 9,317 (1972)), an $In_2O_3/SnO_2$ thin film (M. Hartwell and C. G. Fonstad, "IEEE Trans. ED Conf.", 519 (1975)), and a carbon thin film (Hisashi Araki, et al., "Vacuum", Vol. 26, No. 1, p. 22 (1983)), and the like, in addition to an $SnO_2$ thin film according to Elinson mentioned above.

FIG. 25 is a plan view of the surface-conduction emitting device according to M. Hartwell et al. as a typical example of the structures of these surface conduction electron-emitting devices. Referring to FIG. 25, reference numeral 3001 denotes a substrate; and 3004, a conductive thin film made of a metal oxide formed by sputtering. This conductive thin film 3004 has an H-shaped pattern, as shown in FIG. 25. An electron-emitting portion 3005 is formed by performing an electrification process (referred to as an energization forming process to be described later) with respect to the conductive thin film 3004. Referring to FIG. 25, a spacing L is set to 0.5 to 1 [mm], and a width W is set to 0.1 [mm]. The electron-emitting portion 3005 is shown in a rectangular shape at the center of the conductive thin film 3004 for the sake of illustrative convenience, however, this does not exactly show the actual position and shape of the electron-emitting portion.

In the above surface conduction electron-emitting device by M. Hartwell et al., typically the electron-emitting portion 3005 is formed by performing the electrification process called the energization forming process for the conductive thin film 3004 before electron emission. According to the energization forming process, electrification is performed by applying a constant DC voltage which increases at a very slow rate of, e.g., 1 V/min, to both ends of the conductive thin film 3004, so as to partially destroy or deform the conductive thin film 3004 or change the properties of the conductive thin film 3004, thereby forming the electron-emitting portion 3005 with an electrically high resistance. Note that the destroyed or deformed part of the conductive thin film 3004 or part where the properties are changed has a fissure. Upon application of an appropriate voltage to the conductive thin film 3004 after the energization forming process, electron emission is performed near the fissure.

The above surface conduction electron-emitting devices are advantageous because, of cold cathode devices, they have a simple structure and can be easily manufactured. For this reason, many devices can be formed on a wide area. As disclosed in Japanese Patent Laid-Open No. 64-31332 filed by the present applicant, a method of arranging and driving a lot of devices has been studied.

Regarding applications of surface conduction electron-emitting devices to, e.g., image forming apparatuses such as an image display apparatus and an image recording apparatus, charged beam sources and the like have been studied.

As an application to image display apparatuses, in particular, as disclosed in U.S. Pat. No. 5,066,883 and Japanese Patent Laid-Open Nos. 2-257551 and 4-28137 filed by the present applicant, an image display apparatus using the combination of a surface conduction electron-emitting device and a phosphor which emits light upon irradiation of an electron beam has been studied. This type of image display apparatus is expected to have more excellent characteristics than other conventional image display apparatuses. For example, in comparison with recent popular liquid crystal display apparatuses, the above display apparatus is superior in that is does not require a backlight since it is of a light emissive type and that it has a wide view angle.

The present inventors have examined cold cathode devices according to various materials, manufacturing methods, and structures, in addition to the above conventional devices. The present inventors have also studied a multi-electron-beam source in which a lot of cold cathode devices are arranged, and an image display apparatus to which this multi-electron-beam source is applied.

The present inventors have also examined a multi-electron-beam source according to an electric wiring method shown in FIG. 26. More specifically, this multi-electron-beam source is constituted by two-dimensionally arranging a large number of cold cathode devices and wiring these devices in a matrix, as shown in FIG. 26.

Referring to FIG. 26, reference numeral 4001 denotes a cold cathode device; 4002, a row wiring layer; and 4003, a column wiring layer. The row wiring layers 4002 and the column wiring layers 4003 actually have limited electrical resistances which are represented as wiring resistances 4004 and 4005 in FIG. 26. The wiring shown in FIG. 26 is referred to as simple matrix wiring. For the illustrative convenience, the multi-electron-beam source constituted by a 6×6 matrix is shown in FIG. 26. However, the scale of the matrix is not limited to this arrangement, as a matter of course. In a multi-electron-beam source for an image forming apparatus, a number of devices sufficient to perform desired image display are arranged and wired.

In the multi-electron-beam source in which the surface conduction electron-emitting devices are wired in a simple matrix, appropriate electrical signals are supplied to the row wiring layers 4002 and the column wiring layers 4003 to output desired electron beams. When the surface conduction electron-emitting devices of an arbitrary row of the matrix are to be driven, a selection voltage Vs is applied to the row wiring layer 4002 of the selected row. Simultaneously, a non-selection voltage Vns is applied to the row wiring layers 4002 of unselected rows. In synchronism with this operation, a driving voltage Ve for outputting electron beams is applied to all the column wiring layers 4003. According to this method, a voltage (Ve−Vs) is applied to the surface conduction electron-emitting devices of the selected row, and a voltage (Ve−Vns) is applied to the surface conduction electron-emitting devices of the unselected rows, assuming that a voltage drop caused by the wiring resistances 4004 and 4005 is negligible. When the voltages Ve, Vs, and Vns are set to appropriate levels, electron beams with a desired intensity are output from only the surface conduction electron-emitting devices of the selected row. When different driving voltages Ve are applied to the respective column wiring layers 4003, electron beams with different intensities are output from the respective devices of the selected row. Since the response rate of the surface conduction electron-emitting device is fast, the period of time over which electron beams are output can also be changed in accordance with the period of time for applying the driving voltage Ve.

The multi-electron-beam source having surface conduction electron-emitting devices arranged in a simple matrix can be used in a variety of applications. For example, the multi-electron-beam source can be suitably used as an electron source for an image forming apparatus by appropriately supplying an electrical signal according to image information.

As a result of extensive studies for improving the characteristics of the surface conduction electron-emitting device, the present inventors found that an activation process in the manufacturing process was effective.

As described above, when the electron-emitting portion of the surface conduction electron-emitting device is to be formed, a process (energization forming process) of flowing a current to the conductive thin film to locally destroy, deform, or deteriorate the thin film and form a fissure is performed. Thereafter, when the activation process is performed, the electron-emitting characteristics can be largely improved. More specifically, the activation process is a process of performing electrification of the electron-emitting portion formed by the energization forming process, under appropriate conditions, to deposit carbon or a carbon compound around the electron-emitting portion. For example, a predetermined voltage pulse is periodically applied in a vacuum atmosphere in which an organic substance at an appropriate partial pressure exists, and the total pressure is $10^{-4}$ to $10^{-5}$ [Torr]. With this process, any of monocrystalline graphite, polycrystalline graphite, amorphous carbon, and a mixture thereof is deposited near the electron-emitting portion to a thickness of about 500 [Å] or less. These conditions are only examples and must be appropriately changed in accordance with the material and shape of the surface conduction electron-emitting device.

With this process, comparing the electron-emitting portion with that before the activation process, the emission current at the same applied voltage can be increased typically about 100 times or more. Therefore, in manufacturing a multi-electron-beam source using a lot of surface conduction electron-emitting devices as well, the activation process is preferably performed for each device.

After the activation process is completed, for the purpose of stabilizing the electron-emitting characteristics of the surface conduction electron-emitting device, the partial pressure of an organic gas in the vacuum atmosphere around the surface conduction electron-emitting device is reduced, thereby preventing further deposition of carbon or a carbon compound at the electron-emitting portion or its peripheral portion even when a voltage is applied to the surface conduction electron-emitting device, and this state must be maintained. Preferably, the partial pressure of the organic gas in the atmosphere is reduced to $10^{-8}$ [Torr] or less, and this state is maintained. If possible, the partial pressure is preferably maintained at $10^{-10}$ [Torr] or less. Note that the partial pressure of the organic gas is obtained by integrating the partial pressures of organic molecules having carbon and hydrogen as major ingredients and having a mass number of 13 to 200, which is quantitatively measured using a mass spectrograph.

A typical method of reducing the partial pressure of the organic gas around the surface conduction electron-emitting device is as follows. The vacuum vessel incorporating the substrate on which the surface conduction electron-emitting device is formed is heated. While desorbing the organic gas molecules from the surface of each member in the vessel, vacuum evacuation is performed using a vacuum pump such as a sorption pump or an ion pump using no oil. After the partial pressure of the organic gas is reduced in this manner, this state can be maintained by continuously performing evacuation using the vacuum pump with no oil. However, this method using the vacuum pump for continuous evacuation has disadvantages in volume, power consumption, weight, and cost depending on the application purpose. When the surface conduction electron-emitting device is to be applied to an image display apparatus, the organic gas molecules are sufficiently desorbed to reduce the partial pressure of the organic gas, and thereafter, a getter film is formed in the vacuum vessel, and at the same time, the exhaust pipe is sealed, thereby maintaining the state.

With this process, neither carbon nor carbon compound are newly deposited by electrification or a change in the surface conduction electron-emitting device with the elapse of time after the activation process, so that the electron-emitting characteristics can be stabilized.

As described above, measures for improving and stabilizing the electron-emitting characteristics of the surface conduction electron-emitting device are taken, though the multi-electron-beam source using the surface conduction electron-emitting device has the following problem.

In some cases, the peak value of a voltage applied to drive the multi-electron-beam source increases due to the temperature characteristic (e.g., a temperature drift) of the driving circuit, or instantaneously increases due to a disturbance (e.g., noise or static electricity of the circuit), as shown in FIG. 3. When this increase in voltage value increases the peak value of the driving voltage beyond a predetermined value (the largest one of voltage values applied to the multi-electron-beam source previously), the device characteristics of the surface conduction electron-emitting device change immediately after the voltage is applied to the multi-electron-beam source. For this reason, even when the same voltage as that before the change in characteristics of the surface conduction electron-emitting device of the multi-electron-beam source is applied, the electron emission amount changes (decreases). When the multi-electron-beam source is applied to an image display apparatus, the luminance of a row where an image is displayed during the driving operation decreases, resulting in, e.g., a luminance variation in the row direction of the display image.

SUMMARY OF THE INVENTION

The present invention has been made in consideration of the above conventional situation, and has as its object to provide an electron generating apparatus which is hardly influenced by variations in driving voltage, an image forming apparatus using the electron generating apparatus, and a method of manufacturing and adjusting the same.

In order to achieve the above object, the present invention provides an electron generating apparatus comprising a plurality of surface conduction electron-emitting devices arranged in a matrix on a substrate, wherein the plurality of surface conduction electron-emitting devices are applied in advance with a voltage pulse having a value larger than a voltage value corresponding to a sum of a maximum value of a normal driving voltage and a noise voltage likely to enter into the surface conduction electron-emitting device.

Preferably, the surface conduction electron-emitting devices are arranged in a vacuum vessel in which a partial pressure of an organic gas is not more than $10^{-8}$ Torr.

Preferably, the plurality of surface conduction electron-emitting devices are two-dimensionally arranged and connected in the matrix by row wiring layers and column wiring layers.

Preferably, the value of the pulse voltage is 1.05 to 1.5 times the maximum value of the driving voltage.

Preferably, the plurality of surface conduction electron-emitting devices are two-dimensionally arranged, and the apparatus further comprises grid electrodes for adjusting an amount of electron beams emitted from the surface conduction electron-emitting devices.

The present invention also incorporates an image forming apparatus comprising the above electron generating apparatus, and a phosphor which is excited and emits light upon irradiation of an electron beam.

The present invention also incorporates a method of manufacturing an electron generating apparatus having a multi-electron-beam source in which a plurality of surface conduction electron-emitting devices are arranged, and driving means for applying a driving voltage to the multi-electron-beam source on the basis of an input image signal, comprising applying a characteristic shift voltage having a value larger than a voltage value corresponding to a sum of a maximum value of the driving voltage and a noise voltage generated by the driving means to the plurality of surface conduction electron-emitting devices in advance. Preferably, the characteristic shift voltage is applied in an atmosphere in which a partial pressure of an organic gas is not more than $10^{-8}$ Torr. Preferably, the characteristic shift voltage is 1.05 to 1.5 times the maximum value of the driving voltage. According to the present invention, there is provided a method of manufacturing an image forming apparatus having, above an electron generating apparatus, a phosphor which is excited and emits light upon irradiation of an electron beam, comprising using the method of manufacturing the electron generating apparatus.

The present invention also incorporates a method of adjusting an image forming apparatus, in which, when a noise voltage included in a driving voltage increases after completion of manufacturing an electron generating apparatus or an image forming apparatus, the electron-emitting characteristic of a surface conduction electron-emitting device is shifted in consideration of a safety margin to noise voltage. The present invention provides a method of adjusting an electron generating apparatus having a multi-electron-beam source in which a plurality of surface conduction electron-emitting devices are arranged, and driving means for applying a driving voltage to the multi-electron-beam source on the basis of an input image signal, comprising applying a characteristic shift voltage having a value larger than a voltage value corresponding to a sum of a maximum value of the driving voltage and a noise voltage generated by the driving means to the plurality of surface conduction electron-emitting devices in advance. Preferably, the characteristic shift voltage is applied in an atmosphere in which a partial pressure of an organic gas is not more than $10^{-8}$ Torr. Preferably, the characteristic shift voltage is 1.05 to 1.5 times the maximum value of the driving voltage. According to the present invention, there is provided a method of adjusting an image forming apparatus having, above an electron generating apparatus, a phosphor which is excited and emits light upon irradiation of an electron beam, comprising using the method of adjusting the electron generating apparatus.

The electron generating apparatus of the present invention can be used for EB (Electron Beam) drawing in the semiconductor manufacturing process.

According to the present invention, an electron generating apparatus which is hardly influenced by variations in driving voltage, an image forming apparatus using the electron generating apparatus, and a method of manufacturing and adjusting the same can be provided.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

An electron-emitting characteristic memory function exhibited by a surface conduction electron-emitting device will be described first.

The present inventors drove a surface conduction electron-emitting device having undergone energization forming process and activation process in an atmosphere where the partial pressure of an organic gas was reduced, and measured its electrical characteristics.

Figure 1A:
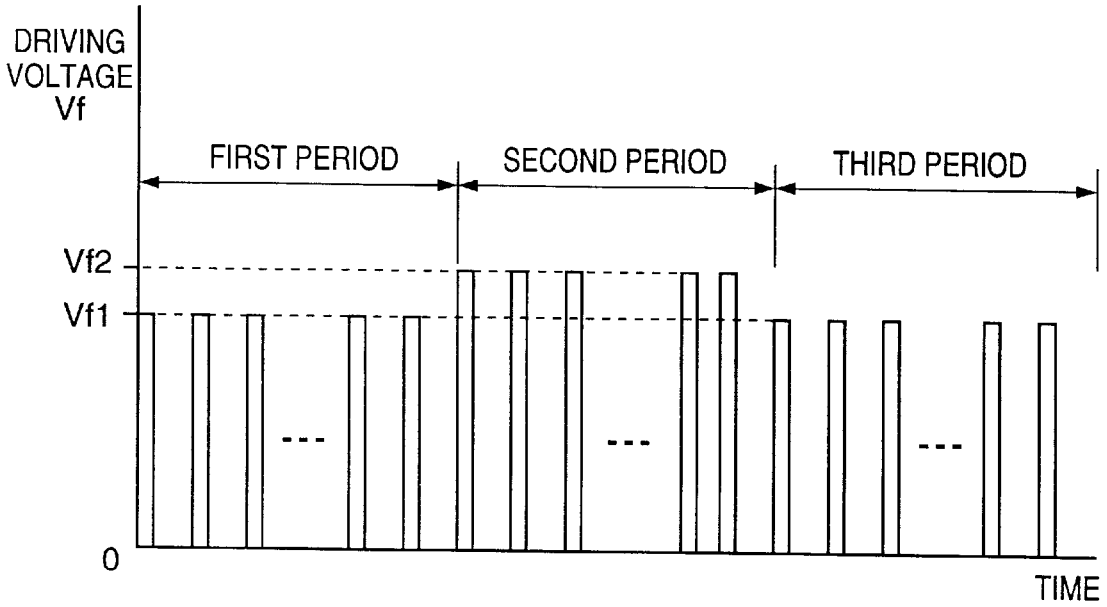
FIGS. 1A and 1B are charts showing the waveform of a voltage used in measurement and shift of the electrical characteristics of a surface conduction electron-emitting device according to the present invention.
Figure 1B:
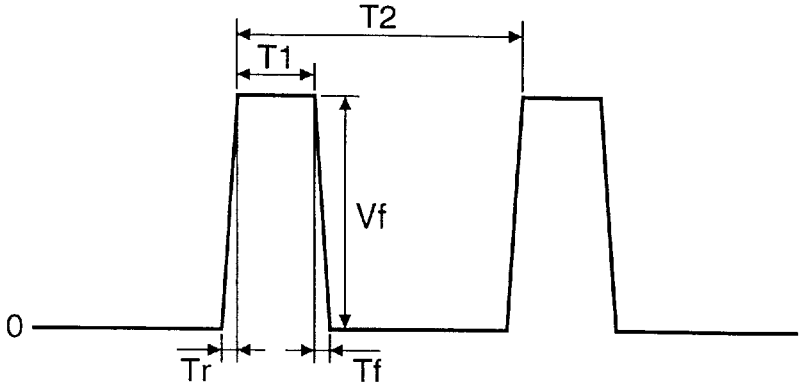

FIGS. 1A and 1B are charts showing the voltage waveform of a driving signal applied to the surface conduction electron-emitting device. The abscissa represents the time axis; and the ordinate, the voltage (to be referred to as a device voltage Vf hereinafter) applied to the surface conduction electron-emitting device.

As shown in FIG. 1A, consecutive rectangular voltage pulses were used as a driving signal, and the application period of the voltage pulses was divided into three periods, namely first to third periods. In each period, 100 identical pulses were applied. FIG. 1B is an enlarged view of the waveform of such a voltage pulse shown in FIG. 1A.

Measurement conditions were: pulse width T1=66.8 [μsec] and pulse period T2=16.7 [msec] in each period. These conditions were determined with reference to the standard driving conditions set when a surface conduction electron-emitting device was applied to a general TV receiver. However, the memory function can be measured under other conditions. Note that measurement was performed while the impedance of a wiring path from a driving signal source to each surface conduction electron-emitting device was sufficiently reduced such that both a rise time Tr and a fall time Tf of a voltage pulse effectively applied to the surface conduction electron-emitting device became equal to or lower than 100 [ns].

The device voltage Vf was Vf=Vf1 in the first and third periods, and Vf=Vf2 in the second period. Both the device voltages Vf1 and Vf2 were set to be higher than the electron emission threshold voltage of each surface conduction electron-emitting device and to satisfy Vf1<Vf2. Since the electron emission threshold voltage varies depending on the shape and material of a surface conduction electron-emitting device, these voltages are appropriately set in accordance with a surface conduction electron-emitting device to be measured. With regard to an atmosphere around the surface conduction electron-emitting device in a measurement operation, the total pressure was $1\times10^{-6}$ [Torr], and the partial pressure of an organic gas was $1\times10^{-9}$ [Torr].

Figure 2A:
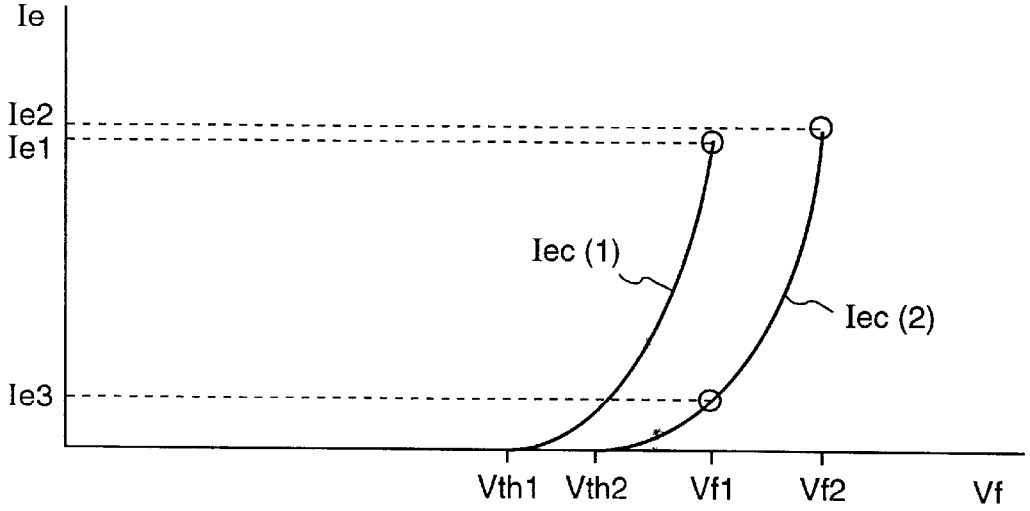
FIGS. 2A and 2B are graphs for explaining the memory function of the surface conduction electron-emitting device of the present invention.
Figure 2B:
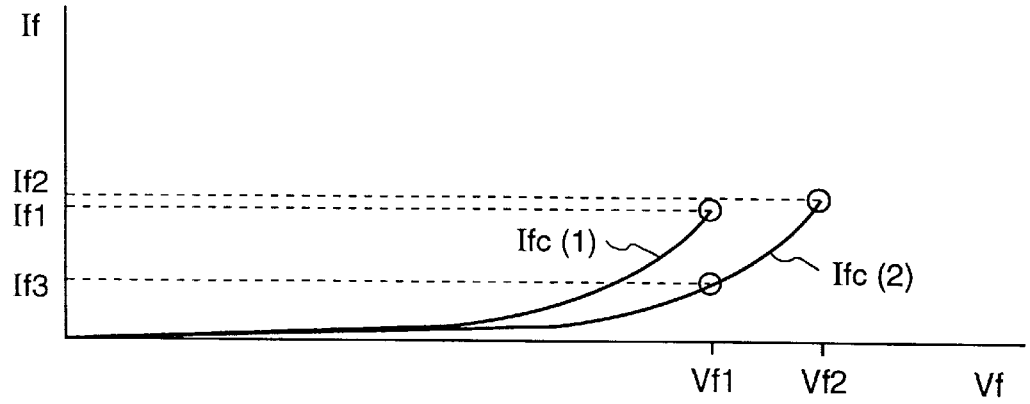
Figure 3:
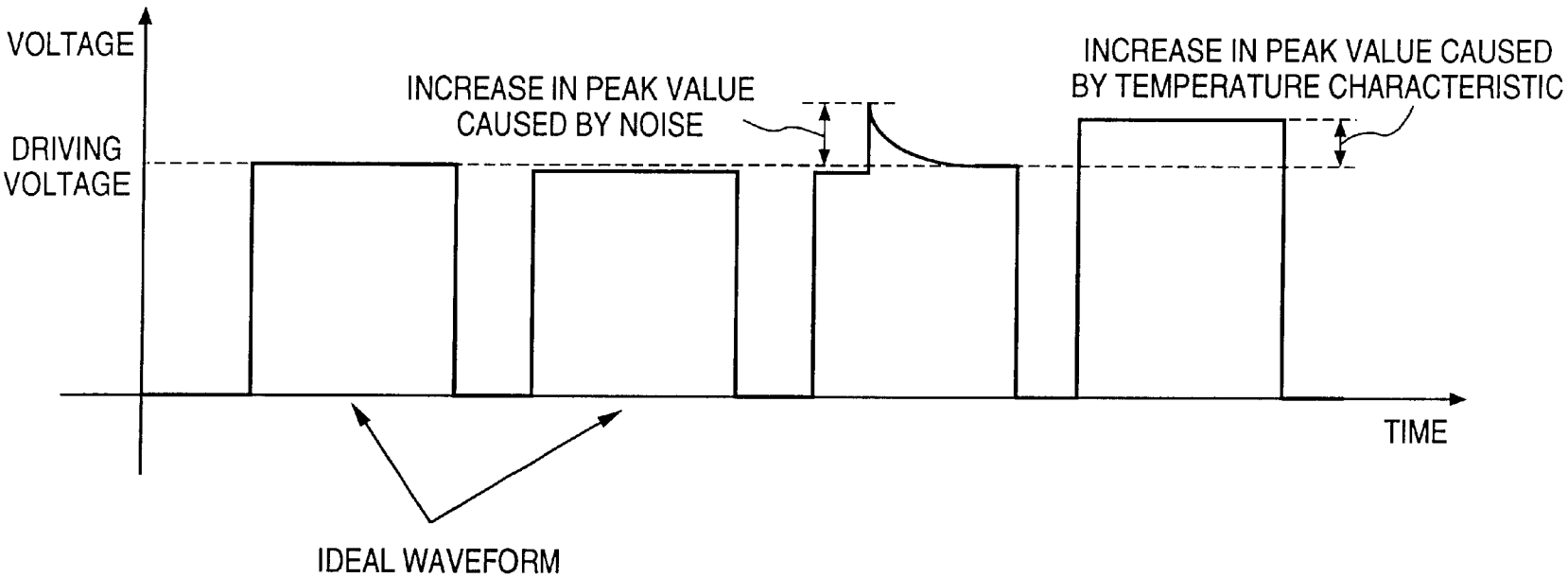
FIG. 3 is a waveform chart for explaining a problem to be solved by the invention, i.e., a distortion of a driving voltage caused by noise or a temperature characteristic.

FIGS. 2A and 2B are graphs showing the electrical characteristics of the surface conduction electron-emitting device upon application of the driving signal shown in FIGS. 1A and 1B. Referring to FIG. 2A, the abscissa represents the device voltage Vf; and the ordinate, the measurement value of a current (to be referred to as an emission current Ie hereinafter) emitted from the surface conduction electron-emitting device. Referring to FIG. 2B, the abscissa represents the device voltage Vf; and the ordinate, the measurement value of a current (to be referred to as a device current If hereinafter) flowing in the surface conduction electron-emitting device.

The (device voltage Vf) vs. (emission current Ie) characteristic shown in FIG. 2A will be described first.

In the first period shown in FIG. 1A, the surface conduction electron-emitting device outputs an emission current according to a characteristic curve Iec(1) in response to a driving pulse. In the rise time Tr of the driving pulse, when the applied voltage Vf exceeds Vth1, the emission current Ie abruptly increases according to the characteristic curve Iec(1). In the period of Vf=Vf1, i.e., the interval of the pulse width T1, the emission current Ie is kept at Ie1. In the fall time Tf of the driving pulse, the emission current Ie abruptly decreases according to the characteristic curve Iec(1).

In the second period, when application of a pulse given by Vf=Vf2 is started, the characteristic curve Iec(1) changes to a characteristic curve Iec(2). More specifically, in the rise time Tr of the driving pulse, when the applied voltage Vf exceeds Vth2, the emission current Ie abruptly increases according to the characteristic curve Iec(2). In the period of Vf=Vf2, i.e., the interval T1, the emission current Ie is kept at Ie2. In the fall time Tf of the driving pulse, the emission current Ie abruptly decreases according to the characteristic curve Iec(2).

In the third period, although the pulse given by Vf=Vf1 is applied again, the emission current Ie changes according to the characteristic curve Iec(2). More specifically, in the rise time Tr of the driving pulse, when the applied voltage Vf exceeds Vth2, the emission current Ie abruptly increases according to the characteristic curve Iec(2). In the period of Vf=Vf1, i.e., the interval T1, the emission current Ie is kept at Ie3. In the fall time Tf of the driving pulse, the emission current Ie abruptly decreases according to the characteristic curve Iec(2).

As described above, in the third period, since the characteristic curve Iec(2) in the second period is stored, the emission current Ie to the device voltage Vf =Vf1 decreases from Ie1 to Ie3 and becomes smaller than that in the first period.

With regard to the (device voltage Vf) vs. (device current If) characteristic as well, as shown in FIG. 2B, the device operates according to a characteristic curve Ifc(1) in the first period. In the second period, however, the device operates according to a characteristic curve Ifc(2). In the third period, the device operates according to the characteristic curve Ifc(2) stored in the second period.

For the sake of descriptive convenience, only the three periods, i.e., the first to third periods, are set. As is apparent, however, the setting is not limited to this condition. In applying a pulse voltage to a surface conduction electron-emitting device having a memory function, when a pulse having a voltage value larger than that of a previously applied pulse is applied, the characteristic curve shifts, and the resultant characteristic is stored. Subsequently, the characteristic curve (electron-emitting characteristic) is kept stored unless a pulse having a larger voltage value is applied. Such a memory function has not been observed in other electron-emitting devices including FE type electron-emitting devices. This characteristic is therefore unique to a surface conduction electron-emitting device.

In this embodiment, all the surface conduction electron-emitting devices of the multi-electron-beam source are applied in advance with a memory voltage Vmn (Vmn= Vdr+ΔV+Vsf) obtained upon adding a voltage ΔV and a safe margin voltage Vsf, estimating the maximum increase amount of the peak value of the driving voltage by the disturbance or temperature characteristic, to a peak value Vdr of an ideal driving voltage such that the device characteristics of all the surface conduction electron-emitting devices are shifted and stored.

When the safe margin voltage Vsf is set to an appropriate value such that the peak value of the actual driving voltage does not increase beyond the memory voltage Vmn due to the disturbance or temperature characteristic, the electron-emitting characteristic is not shifted because of the memory characteristic of the surface conduction electron-emitting device. That is, when the multi-electron-beam source is applied to an image display apparatus, the luminance of the display image during the driving operation is not decreased, or the luminance variation of the display image can be eliminated. The preferable range of the memory voltage Vmn is about 1.05 to 1.5 times the maximum value of the driving voltage.

The preferred embodiments of the present invention will be described below in detail with reference to the accompanying drawings.

First Embodiment

(Arrangement and Manufacturing Method of Display Panel)

The arrangement and manufacturing method of the display panel of an image display apparatus according to the first embodiment of the present invention will be described below with reference to a detailed example.

Figure 4:
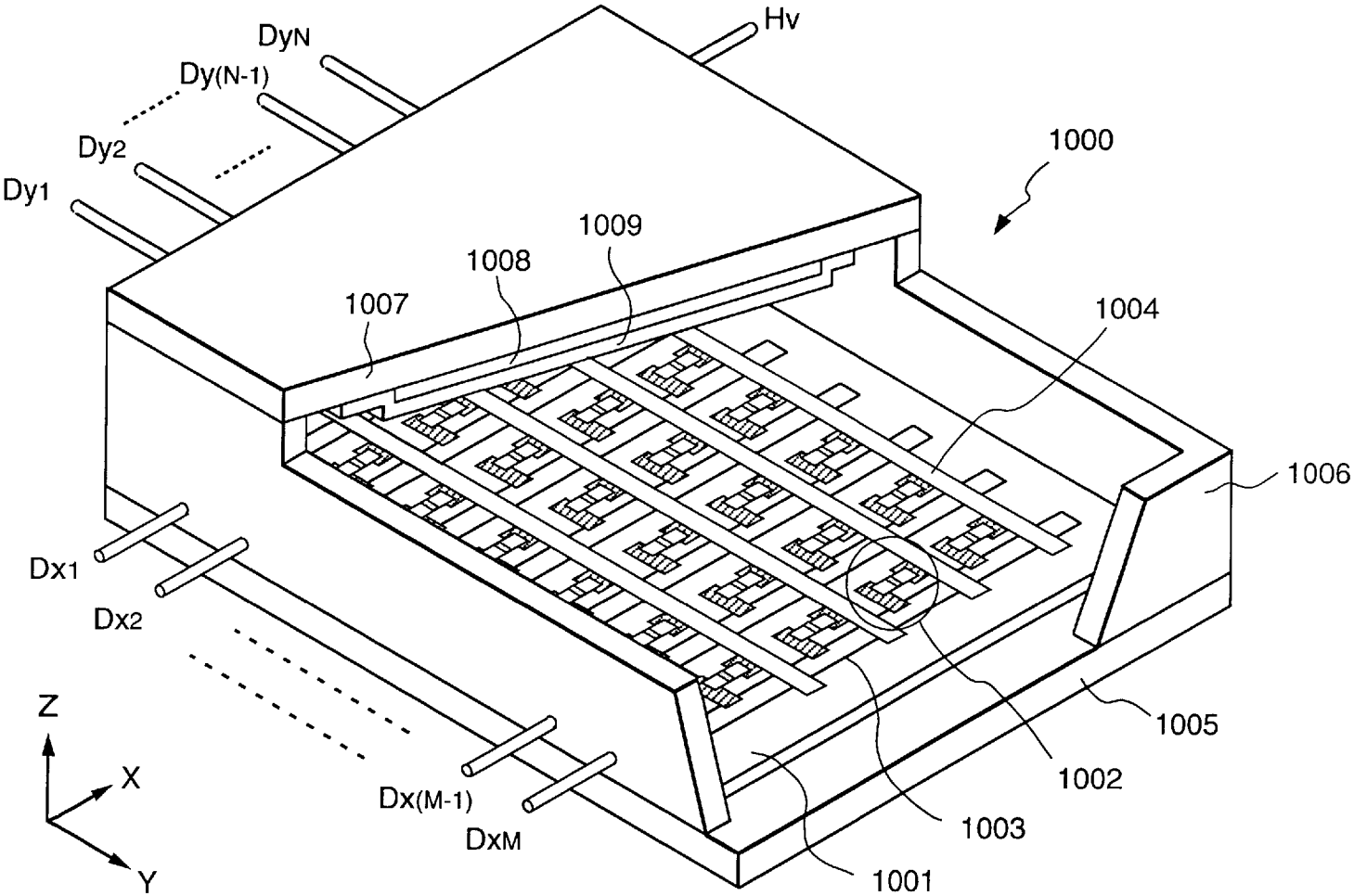
FIG. 4 is a partial cutaway perspective view showing the display panel of an image display apparatus according to the first embodiment.

FIG. 4 is a partially cutaway perspective view of a display panel used in the first embodiment, showing the internal structure of the panel.

Referring to FIG. 4, reference numeral 1005 denotes a rear plate; 1006, a side wall; and 1007, a face plate. These parts 1105 to 1007 form an airtight vessel for maintaining a vacuum in a display panel 1000. To construct the airtight vessel, it is necessary to seal-connect the respective parts to allow their junction portions to hold a sufficient strength and airtight condition. For example, frit glass is applied to the junction portions and sintered at 400° C. to 500° C. in air or a nitrogen atmosphere for 10 minutes or more, thereby seal-connecting the parts. A method of evacuating the airtight vessel will be described later.

The rear plate 1005 has a substrate 1001 fixed thereon, on which N×M surface conduction electron-emitting devices are formed. M and N are positive integers of 2 or more and appropriately set in accordance with a target number of display pixels. For example, in a display apparatus for high-definition television display, preferably N=3,000 or more, and M=1,000 or more. In this embodiment, N=3,071, and M=1,024. The N×M surface conduction electron-emitting devices are arranged in a simple matrix with M row wiring layers 1003 and N column wiring layers 1004. The portion constituted by the substrate 1001, the plurality of electron-emitting devices, the row wiring layers 1003, and the column wiring layers 1004 will be referred to as a multi-electron-beam source. The manufacturing method and structure of the multi-electron-beam source will be described later in detail.

In this embodiment, the substrate 1001 of the multi-electron-beam source is fixed to the rear plate 1005 of the airtight vessel. However, if the substrate 1001 of the multi-electron-beam source has a sufficient strength, the substrate 1001 itself of the multi-electron-beam source may be used as the rear plate of the airtight vessel.

Figure 5A:
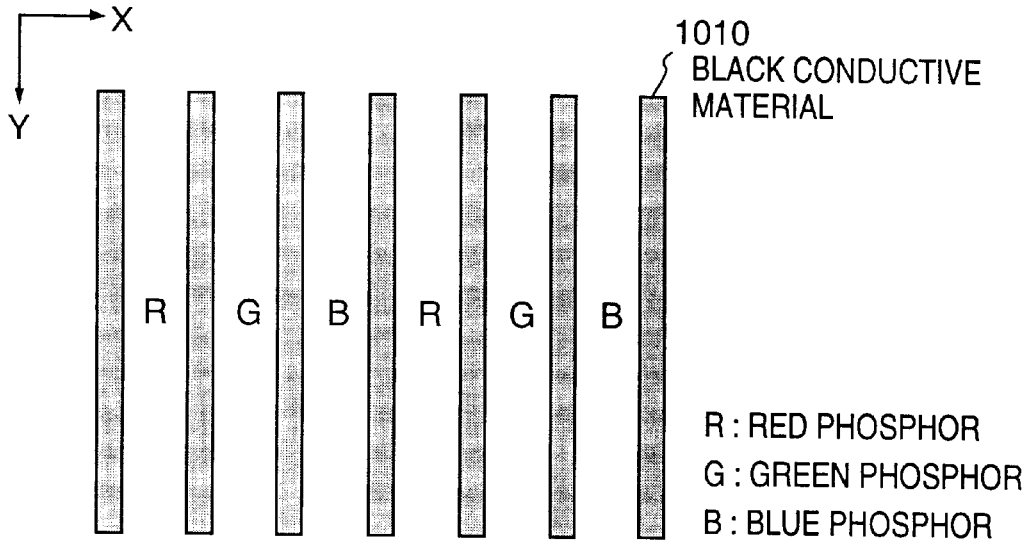
FIGS. 5A and 5B are plan views showing the arrangements of phosphors on the face plate of the display panel of the first embodiment.

Furthermore, a phosphor film 1008 is formed on the lower surface of the face plate 1007. As the display panel 1000 of this embodiment is a color display panel, the phosphor film 1008 is coated with red (R), green (G), and blue (B) phosphors, i.e., three primary color phosphors used in the CRT field. As shown in FIG. 5A, the R, G, and B phosphors are applied in a striped arrangement. A black conductive material 1010 is provided between the stripes of the phosphors. The purpose of providing the black conductive material 1010 is to prevent display color misregistration even if the electron beam irradiation position is shifted to some extent, to prevent degradation of display contrast by shutting off reflection of external light, to prevent charge-up of the phosphor film 1008 by electron beams, and the like. The black conductive material 1010 mainly consists of graphite, though any other material may be used as long as the above purpose can be attained.

Figure 5B:
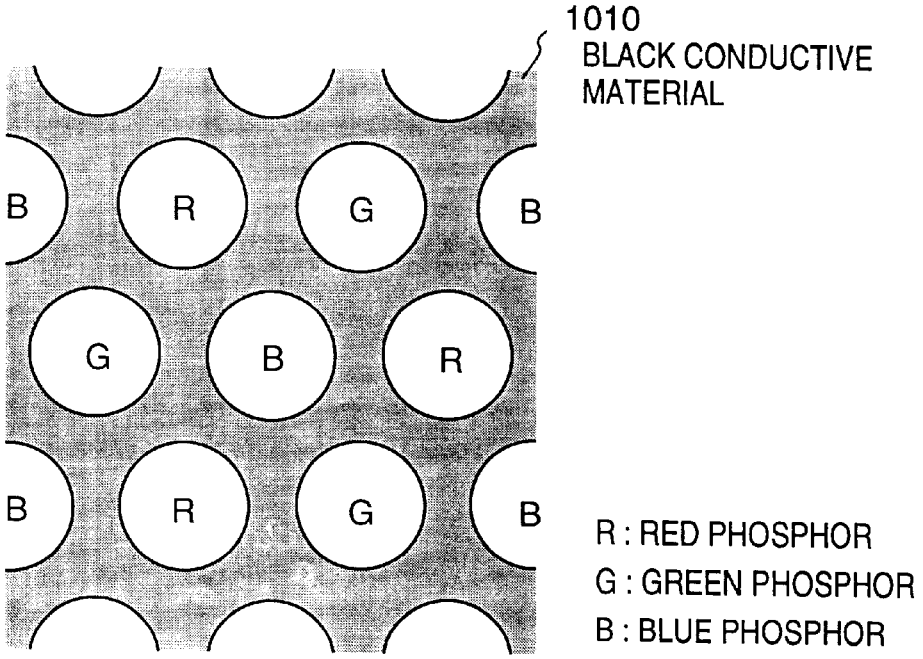

The arrangement of the phosphors of the three primary colors, i.e., R, G, and B is not limited to the striped arrangement shown in FIG. 5A. For example, a delta arrangement shown in FIG. 5B or other arrangements may be employed.

When a monochromatic display panel is to be formed, a monochromatic phosphor material must be used for the phosphor film 1008. In this case, the black conductive material 1010 need not always be used. Furthermore, a metal back 1009, which is well-known in the CRT field, is provided on the rear plate side surface of the phosphor film 1008. The purpose of providing the metal back 1009 is to improve the light-utilization ratio by mirror-reflecting part of light emitted from the phosphor film 1008, to protect the phosphor film 1008 from collision with negative ions, to use the metal back 1009 as an electrode for applying an electron beam accelerating voltage, to use the metal back 1009 as a conductive path of electrons which excited the phosphor film 1008, and the like. The metal back 1009 is formed by forming the phosphor film 1008 on the face plate 1007, applying a smoothing process to the phosphor film surface, and depositing aluminum (Al) thereon by vacuum deposition. Note that when a phosphor material for a low voltage is used for the phosphor film 1008, the metal back 1009 is not used.

Furthermore, for application of an accelerating voltage or improvement of the conductivity of the phosphor film, transparent electrodes made of, e.g., ITO may be provided between the face plate 1007 and the phosphor film 1008.

Referring to FIG. 4, reference symbols Dx1 to DxM, Dy1 to DyN, and Hv denote electric connection terminals for an airtight structure provided to electrically connect the display panel 1000 to an electric circuit (to be described later). The terminals Dx1 to DxM are electrically connected to the row wiring layers 1003 of the substrate 1001; the terminals Dy1 to DyN, to the column wiring layers 1004 of the substrate 1001; and the terminal Hv, to the metal back 1009 of the face plate 1007.

To evacuate the airtight vessel, after forming the airtight vessel, an exhaust pipe and a vacuum pump (neither are shown) using no oil are connected, and the airtight vessel is evacuated to a vacuum of about $10^{-7}$ [Torr]. While keeping evacuation, the display panel 1000 is heated to 80° C. to 200° C. and baked for about 5 hours to reduce the partial pressure of an organic gas. Thereafter, the exhaust pipe is sealed. To maintain the vacuum in the airtight vessel, a getter film (not shown) is formed at a predetermined position in the airtight container immediately before/after the sealing. The getter film is a film formed by heating and evaporating a gettering material mainly consisting of, e.g., Ba, by heating or RF heating. The suction effect of the getter film maintains a vacuum of $1\times10^{-5}$ to $1\times10^{-7}$ [Torr] in the airtight vessel. In this case, the partial pressure of the organic gas mainly consisting of carbon and hydrogen and having a mass number of 13 to 200 is set to be smaller than $10^{-8}$ [Torr].

The basic arrangement and manufacturing method of the display panel 1000 according to the first embodiment have been described above.

A method of manufacturing the multi-electron-beam source used in the display panel 1000 of this embodiment will be described next. For the multi-electron-beam source used in the image display apparatus of this embodiment, any material, shape, and manufacturing method of the surface conduction electron-emitting device may be employed so long as it is for a multi-electron-beam source having surface conduction electron-emitting devices arranged in a simple matrix. However, the present inventors have found that among the surface conduction electron-emitting devices, one having an electron-emitting portion or its peripheral portion consisting of a fine particle film is excellent in electron-emitting characteristic and can be easily manufactured. Accordingly, such a device is the most appropriate surface conduction electron-emitting device to be employed in a high-brightness, large-screen image display apparatus. In the display panel of this embodiment, the surface conduction electron-emitting devices each having an electron-emitting portion or its peripheral portion made of a fine particle film are used. First, the basic structure, manufacturing method, and characteristic of the preferred surface conduction electron-emitting device will be described, and the structure of the multi-electron-beam source having many devices wired in a simple matrix will be described later.

(Preferred Structure and Manufacturing Method of Surface conduction electron-emitting device)

The typical structure of the surface conduction electron-emitting device having an electron-emitting portion or its peripheral portion made of a fine particle film includes a plane type structure and a step type structure.

(Plane Type Surface conduction electron-emitting device)

Figure 6A:
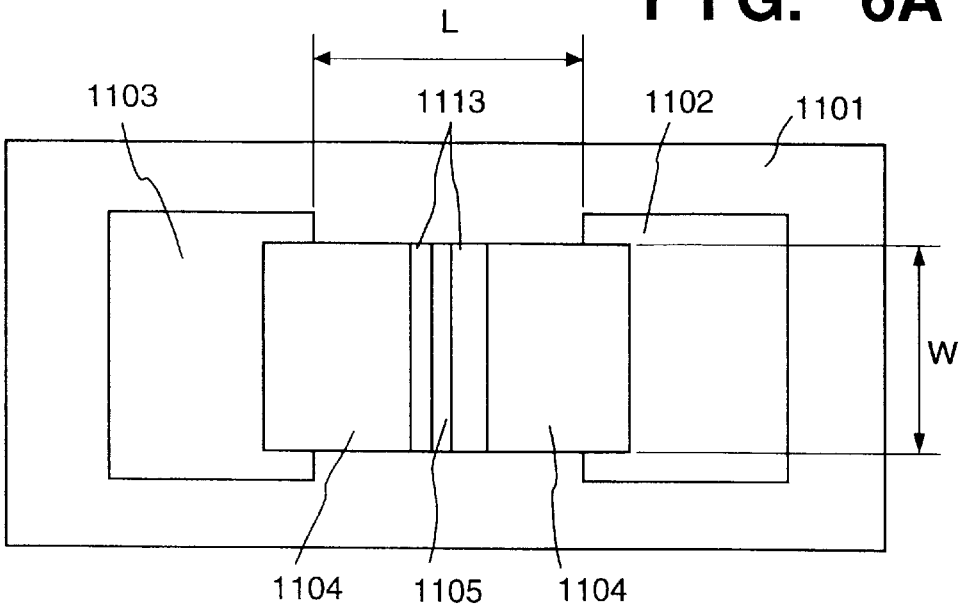
FIGS. 6A and 6B are plan and sectional views of a plane type surface conduction electron-emitting device used in the first embodiment.
Figure 6B:
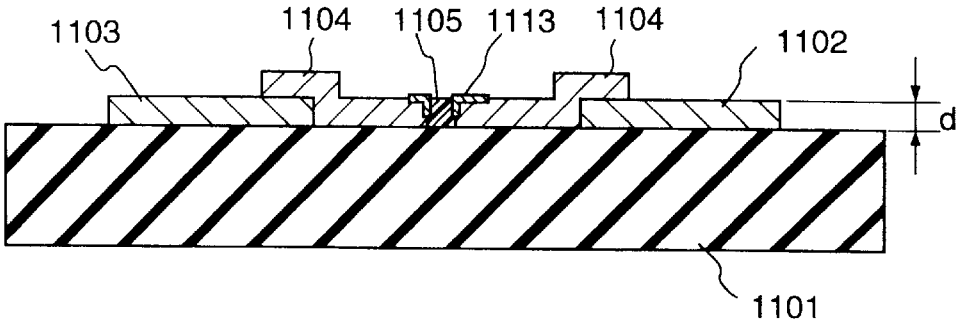

The structure and manufacturing method of a plane type surface conduction electron-emitting device will be described first. FIGS. 6A and 6B are plan and sectional views for explaining the structure of the plane type surface conduction electron-emitting device.

Referring to FIGS. 6A and 6B, reference numeral 1101 denotes a substrate; 1102 and 1103, device electrodes; 1104, a conductive thin film; 1105, an electron-emitting portion formed by an energization forming process; and 1113, a thin film formed by an activation process. As the substrate 1101, various glass substrates of, e.g., silica glass and soda-lime glass, various ceramic substrates of, e.g., alumina, or any of those substrates with an insulating layer consisting of, e.g., $SiO_2$ and formed thereon can be employed. The device electrodes 1102 and 1103 formed on the substrate 1101 to be parallel to its surface and oppose each other are made of a conductive material. For example, one of the following materials may be selected and used: metals such as Ni, Cr, Au, Mo, W, Pt, Ti, Cu, Pd, and Ag, alloys of these materials, metal oxides such as $In_2O_3$—$SnO_2$, and semiconductors such as polysilicon. The device electrodes 1102 and 1103 can be easily formed by the combination of a film-forming technique such as vacuum deposition and a patterning technique such as photolithography or etching, however, any other method (e.g., a printing technique) may be employed.

The shape of the device electrodes 1102 and 1103 is appropriately designed in accordance with an application purpose of the electron-emitting device. Generally, an electrode spacing L is designed to be an appropriate value in a range from several hundreds Å to several hundreds μm. The most preferably range for a display apparatus is from several μm to several tens μm. As for a thickness d of the device electrodes, an appropriate value is generally selected from a range from several hundreds Å to several μm.

The conductive thin film 1104 is made of a fine particle film. The "fine particle film" is a film which contains a lot of fine particles (including an insular aggregate). Microscopic observation of the fine particle film will reveals that the individual fine particles in the film are spaced apart from each other, adjacent to each other, or overlap each other.

One particle in the fine particle film has a diameter within a range from several Å to several thousands Å. Preferably, the diameter falls within a range from 10 Å to 200 Å. The thickness of the fine particle film is appropriately set in consideration of the following conditions: a condition necessary for electrical connection to the device electrode 1102 or 1103, a condition for the energization forming process to be described later, a condition for setting the electric resistance of the fine particle film itself to an appropriate value to be described later. More specifically, the thickness of the film is set in a range from several Å to several thousands Å, and more preferably, 10 Å to 500 Å.

For example, materials used for forming the fine particle film are metals such as Pd, At, Ru, Ag, Au, Ti, In, Cu, Cr, Fe, Zn, Sn, Ta, W, and Pb, oxides such as PdO, $SnO_2$, $In_2O_3$, PbO, and $Sb_2O_3$, borides such as $HfB_2$, $ZrB_2$, $LaB_6$, $CeB_6$, $YB_4$, and $GdB_4$, carbides such as TiC, ZrC, HfC, TaC, SiC, and WC, nitrides such as TiN, ZrN, HfN, semiconductors such as Si and Ge, and carbons. An appropriate material is selected from these materials.

As described above, the conductive thin film 1104 is formed using a fine particle film, and the sheet resistance of the film is set to fall within a range from $10^3$ to $10^7$ [Ω/sq].

As it is preferable that the conductive thin film 1104 is electrically connected to the device electrodes 1102 and 1103, they are arranged so as to partly overlap each other.

Referring to FIGS. 6A and 6B, the respective parts are stacked in the following order from the bottom: the substrate, the device electrodes, and the conductive thin film. This overlapping order may be: the substrate, the conductive thin film, and the device electrodes, from the bottom.

The electron-emitting portion 1105 is a fissure portion formed at a part of the conductive thin film 1104. The electron-emitting portion 1105 has an electric resistance higher than that of the peripheral conductive thin film. The fissure portion is formed by the energization forming process (to be described later) on the conductive thin film 1104. In some cases, particles, having a diameter of several Å to several hundreds Å, are arranged within the fissure portion. As it is difficult to exactly illustrate the actual position and shape of the electron-emitting portion, FIGS. 6A and 6B show the fissure portion schematically.

The thin film 1113, which consists of carbon or a carbon compound, covers the electron-emitting portion 1105 and its peripheral portion. The thin film 1113 is formed by the activation process to be described later after the energization forming process. The thin film 1113 is preferably made of monocrystalline graphite, polycrystalline graphite, amorphous carbon, or a mixture thereof, and its thickness is 500 [Å] or less, and more particularly, 300 [Å] or less. As it is difficult to exactly illustrate the actual position or shape of the thin film 1113, FIGS. 6A and 6B show the film schematically. FIG. 6A is a plan view showing the device in which a part of the thin film 1113 is removed.

The preferred basic structure of the device has been described above. In this embodiment, actually, the following device is used.

The substrate 1101 consists of soda-lime glass, and the device electrodes 1102 and 1103, an Ni thin film. The thickness d of the device electrodes is 1,000 [Å], and the electrode spacing L is 2 [μm]. As the main material for the fine particle film, Pd or PdO is used. The thickness and width W of the fine particle film are respectively set to about 100 [Å] and 100 [μm].

A preferred method of manufacturing the plane type surface conduction electron-emitting device will be described next. FIGS. 7A to 7E are sectional views for explaining steps in manufacturing the plane type surface conduction electron-emitting device. The same reference numerals as in FIGS. 6A and 6B denote the same parts in FIGS. 7A to 7E, and a detailed description thereof will be omitted.

Figure 7A:
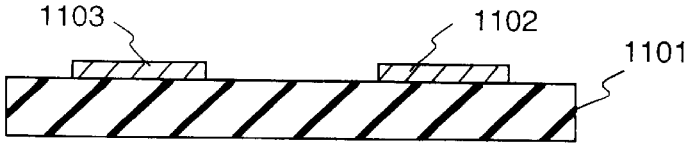
FIGS. 7A to 7E are sectional views showing steps in manufacturing the plane type surface conduction electron-emitting device of the first embodiment.

(1) First, as shown in FIG. 7A, the device electrodes 1102 and 1103 are formed on the substrate 1101. In forming the device electrodes 1102 and 1103, the substrate 1101 is fully cleaned with a detergent, pure water, and an organic solvent, and a material for the device electrodes is deposited on the substrate 1101. As a depositing method, a vacuum film-forming technique such as vapor deposition or sputtering may be used. Thereafter, the deposited electrode material is patterned by a photolithographic etching technique. Thus, the pair of device electrodes (1102 and 1103) in FIG. 7A are formed.

Figure 7B:
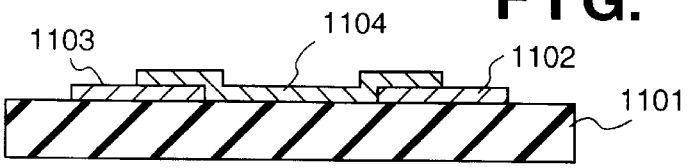

(2) Next, as shown in FIG. 7B, the conductive thin film 1104 is formed.

In forming the conductive thin film, an organic metal solution is applied to the substrate 1101 prepared in FIG. 7A first, and the applied solution is then dried and sintered, thereby forming a fine particle film. Thereafter, the fine particle film is patterned into a predetermined shape by the photolithographic etching method. The organic metal solution means an organic metal compound solution containing a material for fine particles, used for the conductive thin film, as main element. In this embodiment, Pd is used as the main element. In this embodiment, application of an organic metal solution is performed by a dipping method, however, a spinner method or spraying method may be used.

As a method of forming the conductive thin film made of the fine particle film, the application of an organic metal solution used in this embodiment can be replaced with any other method such as a vacuum deposition method, a sputtering method, or a chemical vapor deposition method.

Figure 7C:
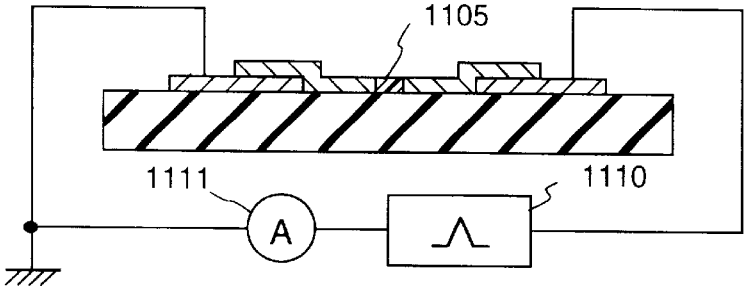

(3) As shown in FIG. 7C, an appropriate voltage is applied between the device electrodes 1102 and 1103, from a power supply 1110 for the energization forming process, and the energization forming process is performed to form the electron-emitting portion 1105.

The energization forming process here is a process of performing electrification for the conductive thin film 1104 made of a fine particle film to appropriately destroy, deform, or deteriorate a part of the conductive thin film, thereby changing the film into a structure suitable for electron emission. In the conductive thin film made of the fine particle film, the portion changed into the structure suitable for electron emission (i.e., the electron-emitting portion 1105) has an appropriate fissure in the thin film. Comparing the thin film having the electron-emitting portion 1105 with the thin film before the energization forming process, the electric resistance measured between the device electrodes 1102 and 1103 has greatly increased.

Figure 8:
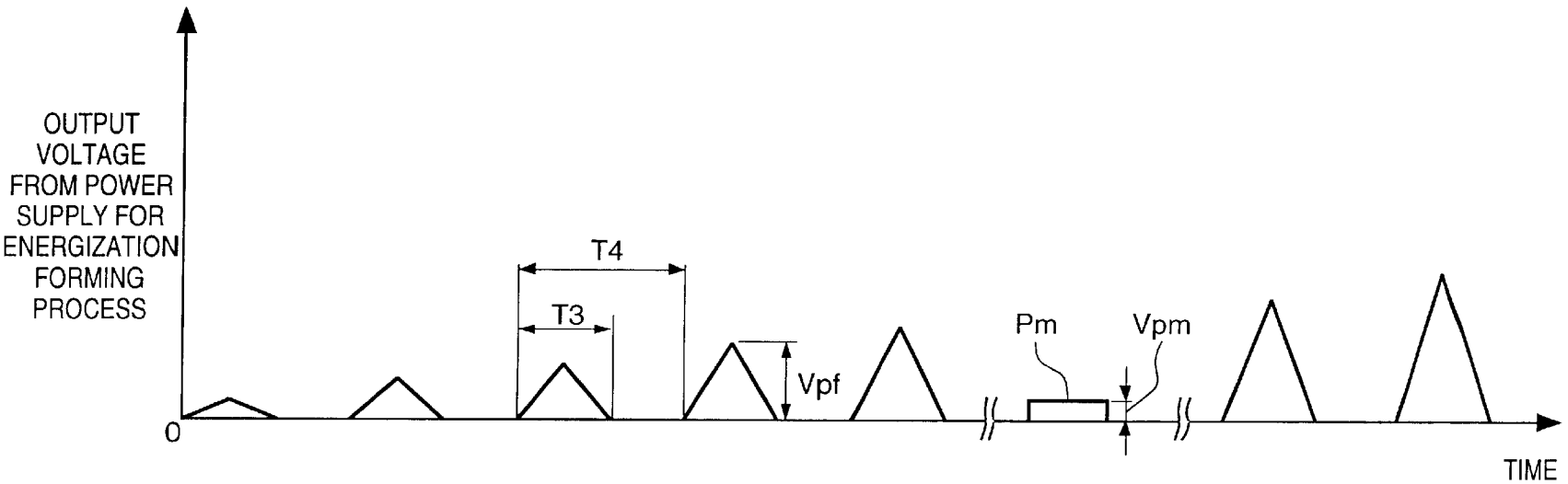
FIG. 8 is a chart showing the waveforms of applied voltages in an energization forming process of the first embodiment.

An electrification method for the energization forming process will be described in detail with reference to FIG. 8 showing an example of the waveform of an appropriate voltage applied from the power supply 1110 for the energization forming process. In the energization forming process to the conductive thin film made of a fine particle film, a pulse-like voltage is preferably employed. In this embodiment, as shown in FIG. 8, a triangular pulse having a pulse width T3 is continuously applied at a pulse interval T4. In this case, a peak value Vpf of the triangular pulse is sequentially increased. Furthermore, a monitor pulse Pm is inserted between the triangular pulses at appropriate intervals to monitor the formed state of the electron-emitting portion 1105, and the current that flows at the insertion is measured by an ammeter 1111.

In this embodiment, in a $10^{-5}$ [Torr] vacuum atmosphere, the pulse width T3 is set to 1 [msec]; and the pulse interval T4, to 10 [msec]. The peak value Vpf is increased by 0.1 [V], at each pulse. Each time five triangular pulses are applied, one monitor pulse Pm is inserted. To avoid adverse effects on the energization forming process, a voltage Vpm of the monitor pulse is set to 0.1 [V]. When the electric resistance between the device electrodes 1102 and 1103 becomes $1\times10^{6}$ [Ω], i.e., the current measured by the ammeter 1111 upon application of the monitor pulse becomes $1\times10^{-7}$ [A] or less, electrification for the energization forming process is terminated.

Note that the above method is preferable to the surface conduction electron-emitting device of this embodiment. In case of changing the design of the surface conduction electron-emitting device concerning, e.g., the material or thickness of the fine particle film, or the spacing L between the device electrodes, the conditions for electrification are preferably changed in accordance with the change in device design.

Figure 7D:
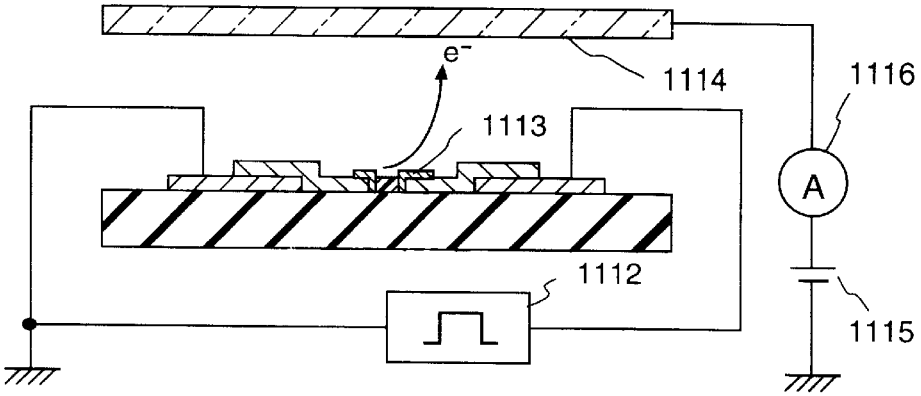

4) As shown in FIG. 7D, an appropriate voltage is applied next, from an activation power supply 1112, between the device electrodes 1102 and 1103, and the activation process is performed to improve the electron-emitting characteristic.

The activation process here is a process of performing electrification of the electron-emitting portion 1105 formed by the energization forming process, under appropriate conditions, to deposit a carbon or carbon compound around the electron-emitting portion 1105. FIG. 7D shows the deposited material of the carbon or carbon compound as the material 1113. Comparing the electron-emitting portion 1105 with that before the activation process, the emission current at the same applied voltage can be increased typically about 100 times or more.

The activation process is performed by periodically applying a voltage pulse in a $10^{-4}$ to $10^{-5}$ [Torr] vacuum atmosphere to deposit a carbon or carbon compound mainly derived from an organic compound existing in the vacuum atmosphere. The deposition material 1113 is any of monocrystalline graphite, polycrystalline graphite, amorphous carbon, and a mixture thereof. The thickness of the deposition material 1113 is 500 [Å] or less, and more preferably, 300 [Å] or less.

Figure 9A:
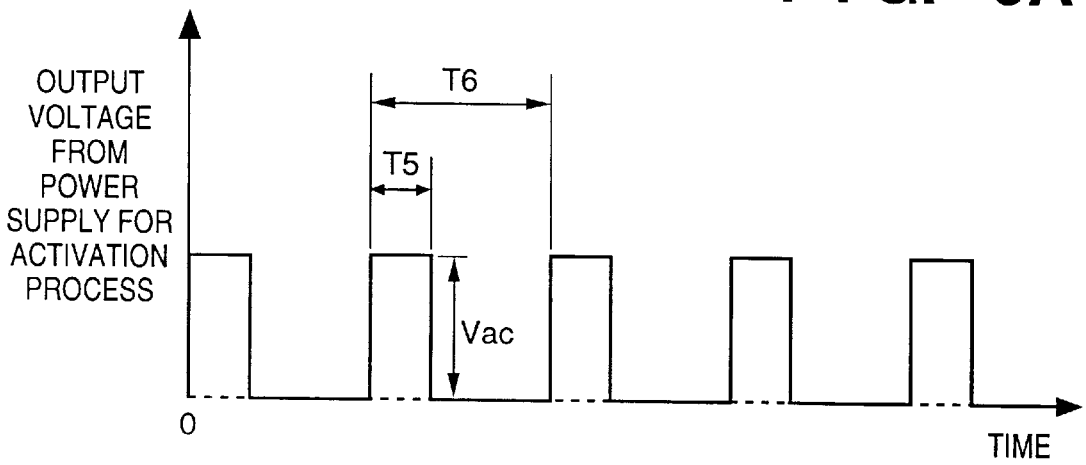
FIGS. 9A and 9B are charts respectively showing the waveforms of an applied voltage and a change in emission current Ie in an activation process of the first embodiment.

FIG. 9A shows an example of the waveform of an appropriate voltage applied from the activation power supply 1112 so as to explain the electrification method in more detail. In this embodiment, the activation process is performed by periodically applying a constant rectangular voltage. More specifically, a rectangular voltage Vac shown is set to 14 [V]; a pulse width T5, to 1 [msec]; and a pulse interval T6, to 10 [msec]. Note that the above electrification conditions are preferable to manufacture the surface conduction electron-emitting device of this embodiment. When the design of the surface conduction electron-emitting device is changed, the conditions are preferably changed in accordance with the change in device design.

Figure 9B:
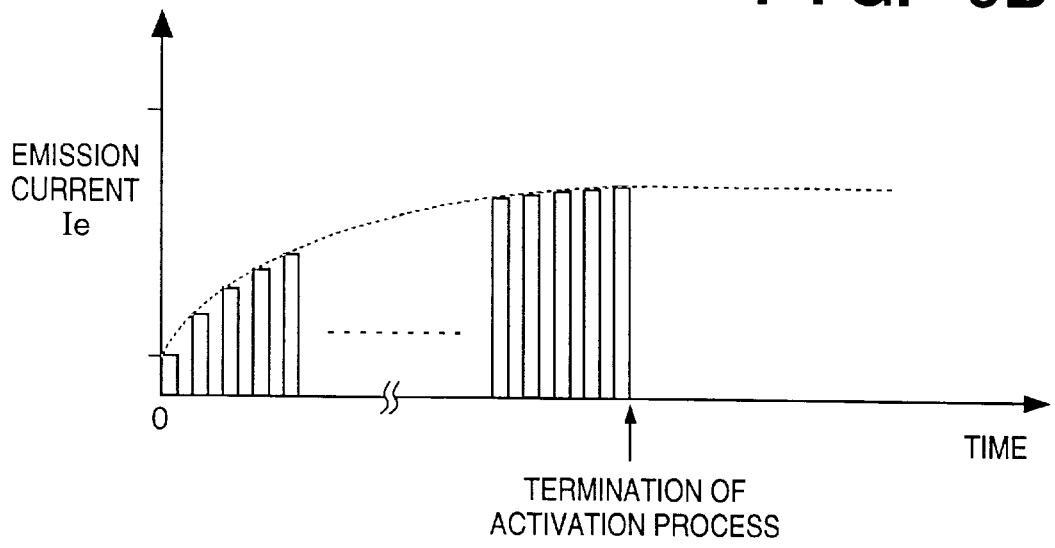

Referring to FIG. 7D, reference numeral 1114 denotes an anode electrode connected to a DC high-voltage power supply 1115 and an ammeter 1116 to capture an emission current Ie emitted from the surface conduction electron-emitting device. Note that when the substrate 1101 is incorporated into the display panel 1000 before the activation process, the phosphor surface of the display panel 1000 is used as the anode electrode 1114. While applying a voltage from the activation power supply 1112, the ammeter 1116 measures the emission current Ie to monitor the progress of the activation process so as to control the operation of the activation power supply 1112. FIG. 9B shows an example of the emission current Ie measured by the ammeter 1116. As application of a pulse voltage from the activation power supply 1112 is started, the emission current Ie increases with the elapse of time, gradually reaches saturation, and rarely increases then. At the substantial saturation point of the emission current Ie, the voltage application from the activation power supply 1112 is stopped, and the activation process is then terminated.

Note that the above electrification conditions are preferable to manufacture the surface conduction electron-emitting device of this embodiment. When the design of the surface conduction electron-emitting device is changed, the conditions are preferably changed in accordance with the change in device design.

Figure 7E:
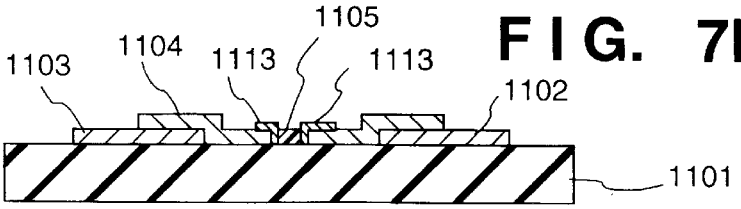

The plane type surface conduction electron-emitting device shown in FIG. 7E is manufactured in the above manner.

(Step Type Surface conduction electron-emitting device)

Another typical surface conduction electron-emitting device having an electron-emitting portion or its peripheral portion formed of a fine particle film, i.e., a step type surface conduction electron-emitting device will be described below.

Figure 10:
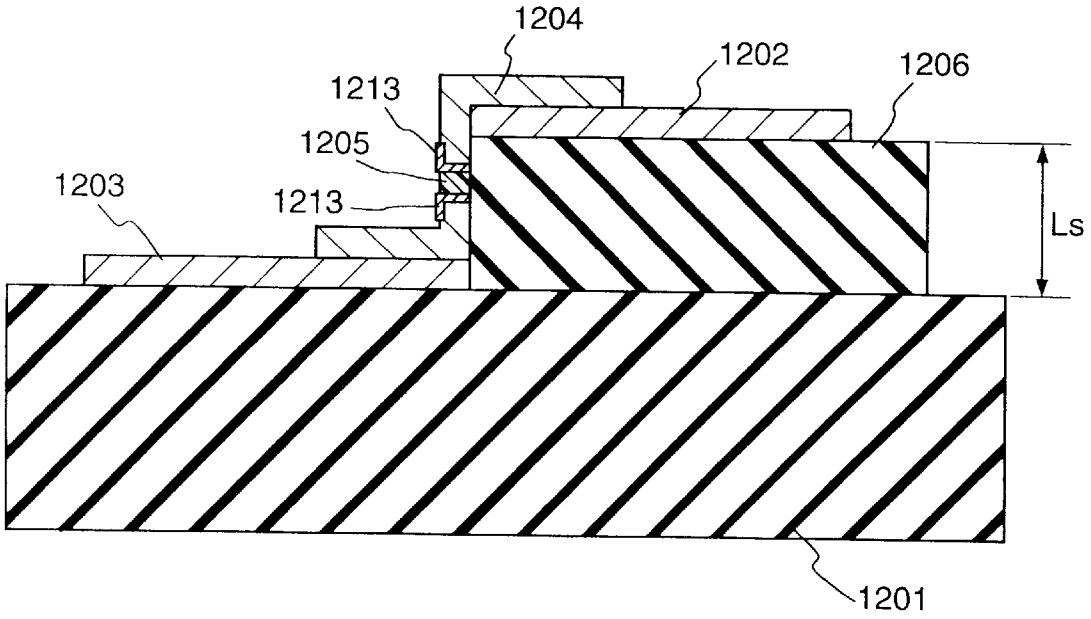
FIG. 10 is a sectional view of a step type surface conduction electron-emitting device used in the first embodiment.

FIG. 10 is a sectional view for explaining the basic arrangement of the step type surface conduction electron-emitting device of this embodiment. Referring to FIG. 10, reference numeral 1201 denotes a substrate; 1202 and 1203, device electrodes; 1206, a step forming member; 1204, a conductive thin film using a fine particle film; 1205, an electron-emitting portion formed by an energization forming process; and 1213, a thin film formed by an activation process. The step type device differs from the plane type surface conduction electron-emitting device described above in that one device electrode (1202) is formed on the step forming member 1206, and the conductive thin film 1204 covers a side surface of the step forming member 1206. Therefore, the device electrode spacing L of the plane type surface conduction electron-emitting device shown in FIGS. 6A and 6B corresponds to a step height Ls of the step forming member 1206 of the step type device. For the substrate 1201, the device electrodes 1202 and 1203, and the conductive thin film 1204 using a fine particle film, the same materials as enumerated in the description of the plane type surface conduction electron-emitting device can be used. For the step forming member 1206, an electrically insulating material such as $SiO_2$ is used.

A method of manufacturing the step type surface conduction electron-emitting device will be described below. FIGS. 11A to 11F are sectional views for explaining steps in manufacturing the step type surface conduction electron-emitting device. The same reference numerals as in FIG. 10 denote the same members in FIGS. 11A to 11F, and a detailed description thereof will be omitted.

Figure 11A:
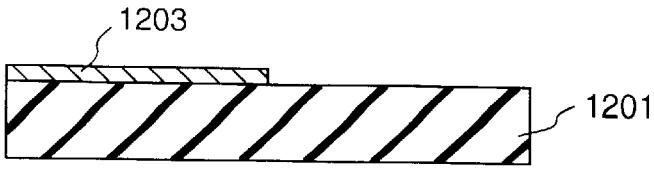
FIGS. 11A to 11F are sectional views showing steps in manufacturing the step type surface conduction electron-emitting device.

(1) As shown in FIG. 11A, the device electrode 1203 is formed on the substrate 1201.

Figure 11B:
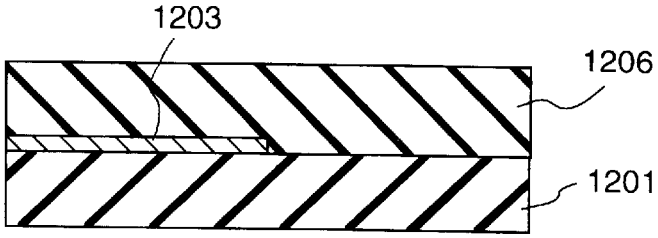

(2) As shown in FIG. 11B, the insulating layer for forming the step forming member is stacked on the resultant structure. For the insulating layer, e.g., an $SiO_2$ layer is formed by sputtering. However, another film-forming method such as vacuum deposition or printing may be used.

Figure 11C:
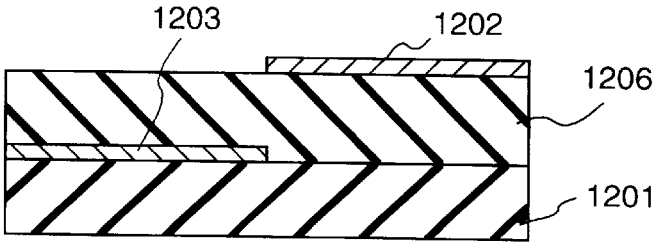

(3) As shown in FIG. 11C, the device electrode 1202 is formed on the insulating layer.

Figure 11D:
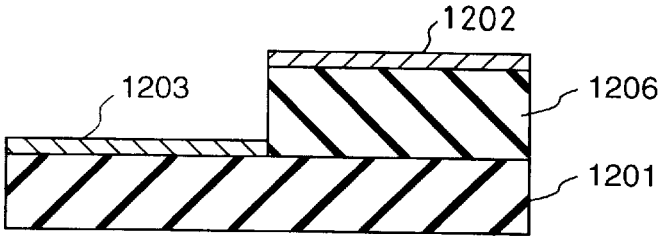

(4) As shown in FIG. 11D, part of the insulating layer is removed by, e.g., etching to expose the device electrode 1203.

Figure 11E:
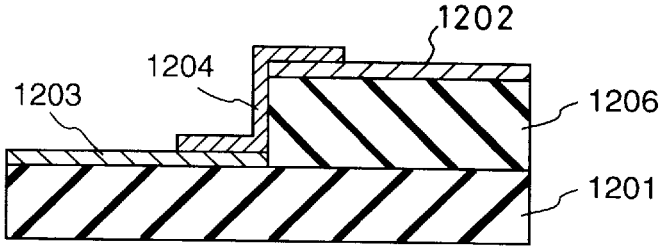

(5) As shown in FIG. 11E, the conductive thin film 1204 using a fine particle film is formed. To form the conductive thin film 1204, a film-forming method such as a coating method can be used, as in the plane type surface conduction electron-emitting device.

(6) As in the plane type surface conduction electron-emitting device, an energization forming process is performed to form an electron-emitting portion (the same energization forming process as that of the plane type surface conduction electron-emitting device, which has been described with reference to FIG. 7C, is performed).

(7) As in the plane type surface conduction electron-emitting device, an activation process is performed to deposit carbon or a carbon compound near the electron-emitting portion (the same activation process as that of the plane type surface conduction electron-emitting device, which has been described with reference to FIG. 7D, is performed).

Figure 11F:
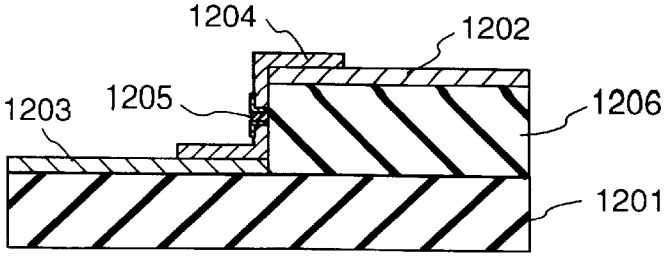

In the above-described manner, the step type surface conduction electron-emitting device shown in FIG. 11F is manufactured.

(Structure of Multi-electron-beam Source Having Many Devices Wired in Simple Matrix)

The structure of a multi-electron-beam source in which the above-described surface conduction electron-emitting devices are arranged on a substrate and wired in a simple matrix will be described below.

Figure 12:
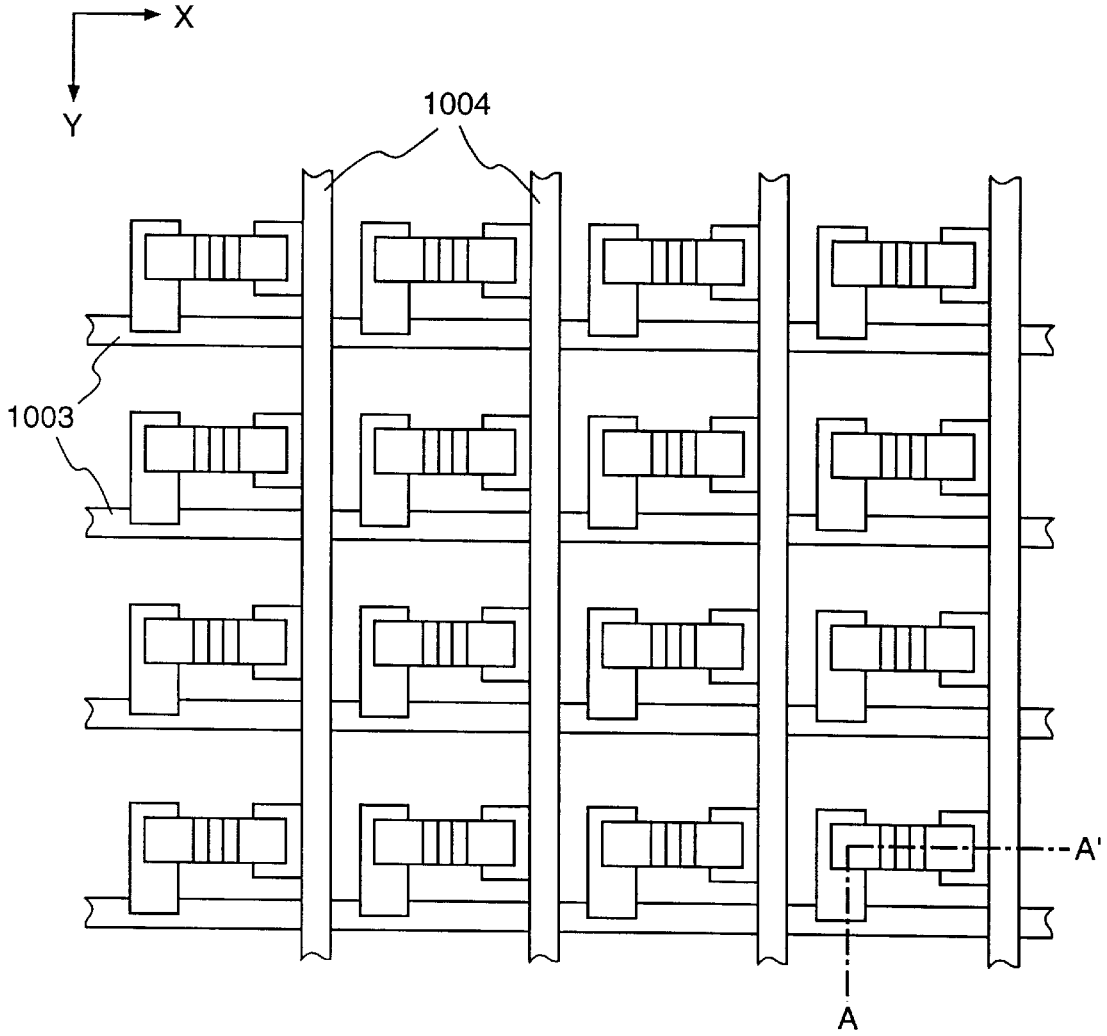
FIG. 12 is a plan view of the substrate of a multi-electron-beam source used in the first embodiment.

FIG. 12 is a plan view showing the multi-electron-beam source used in the display panel 1000 shown in FIG. 4. The surface conduction electron-emitting devices each having the same structure as shown in FIGS. 6A and 6B are arranged on the substrate 1001. These devices are wired in a simple matrix by the row wiring layers 1003 and the column wiring layers 1004. At intersections of the row wiring layers 1003 and the column wiring layers 1004, insulating layers (not shown) are formed between the wiring layers such that electrical insulation is maintained.

Figure 13:
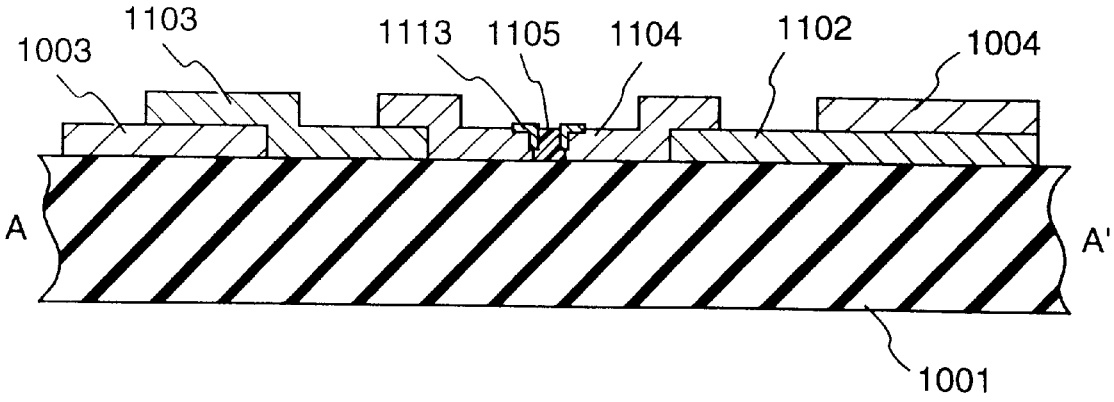
FIG. 13 is a partial sectional view of the substrate of the multi-electron-beam source used in the first embodiment.

FIG. 13 is a sectional view taken along a line A–A' in FIG. 12.

The multi-electron-beam source having the above structure is manufactured in the following manner. The row wiring layers 1003, the column wiring layers 1004, the interelectrode insulating layers (not shown), and the device electrodes and conductive thin films of the surface conduction electron-emitting devices are formed on the substrate 1001 in advance. Thereafter, a power is supplied to the respective devices through the row wiring layers 1003 and the column wiring layers 1004 to perform the energization forming process and the activation process, thereby manufacturing the multi-electron-beam source.

[Method of Changing Electron-Emitting Characteristics]

A process of changing the electron-emitting characteristics of the surface conduction electron-emitting device, which is a feature of this embodiment, will be described below. In this embodiment, the device characteristics of the multi-electron-beam source obtained by the above manufacturing method are changed using the above-described memory function of the surface conduction electron-emitting device, i.e., the function of shifting the electron-emitting characteristics. The memory voltage or characteristic shift voltage is applied using a circuit shown in FIG. 14.

Figure 14:
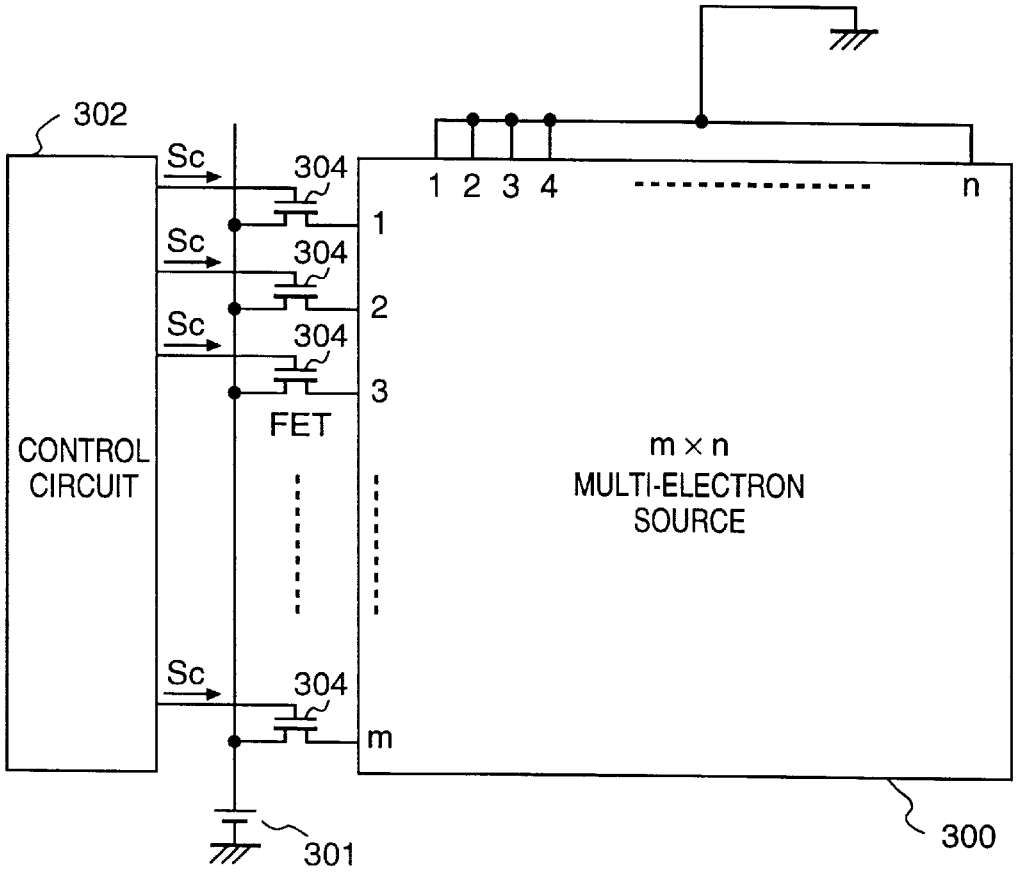
FIG. 14 is a block diagram showing the circuit arrangement for imparting the memory function to the multi-electron-beam source according to the first embodiment.

Referring to FIG. 14, reference numeral 301 denotes a DC voltage source; 302, a control circuit which outputs a timing signal Sc for sequentially switching the row wiring layers of a multi-electron-beam source 300; and 304, an FET. The memory voltage applied in units of rows of the multi-electron-beam source 300 is applied to the respective devices through the row wiring layers by turning on/off the FETs 304 connected to the DC voltage source 301 by the timing signal Sc from the control circuit 302. The control circuit 302 has, e.g., a clock generator and a one-shot multivibrator and generates a pulse width and the waveform of the period for applying the memory voltage. When the memory voltage is to be actually applied using the circuit shown in FIG. 14, aging of the DC voltage source is sufficiently performed to prevent variations in voltage on the row wiring layers. In addition, the wiring layers are made as short as possible to prevent noise inclusion. In this embodiment, all the column wiring layers are grounded.

The circuit for applying the memory voltage is not limited to that shown in FIG. 14. An appropriate voltage can be generated by the above-described activation unit or a display driving circuit to be described later.

Figure 15:
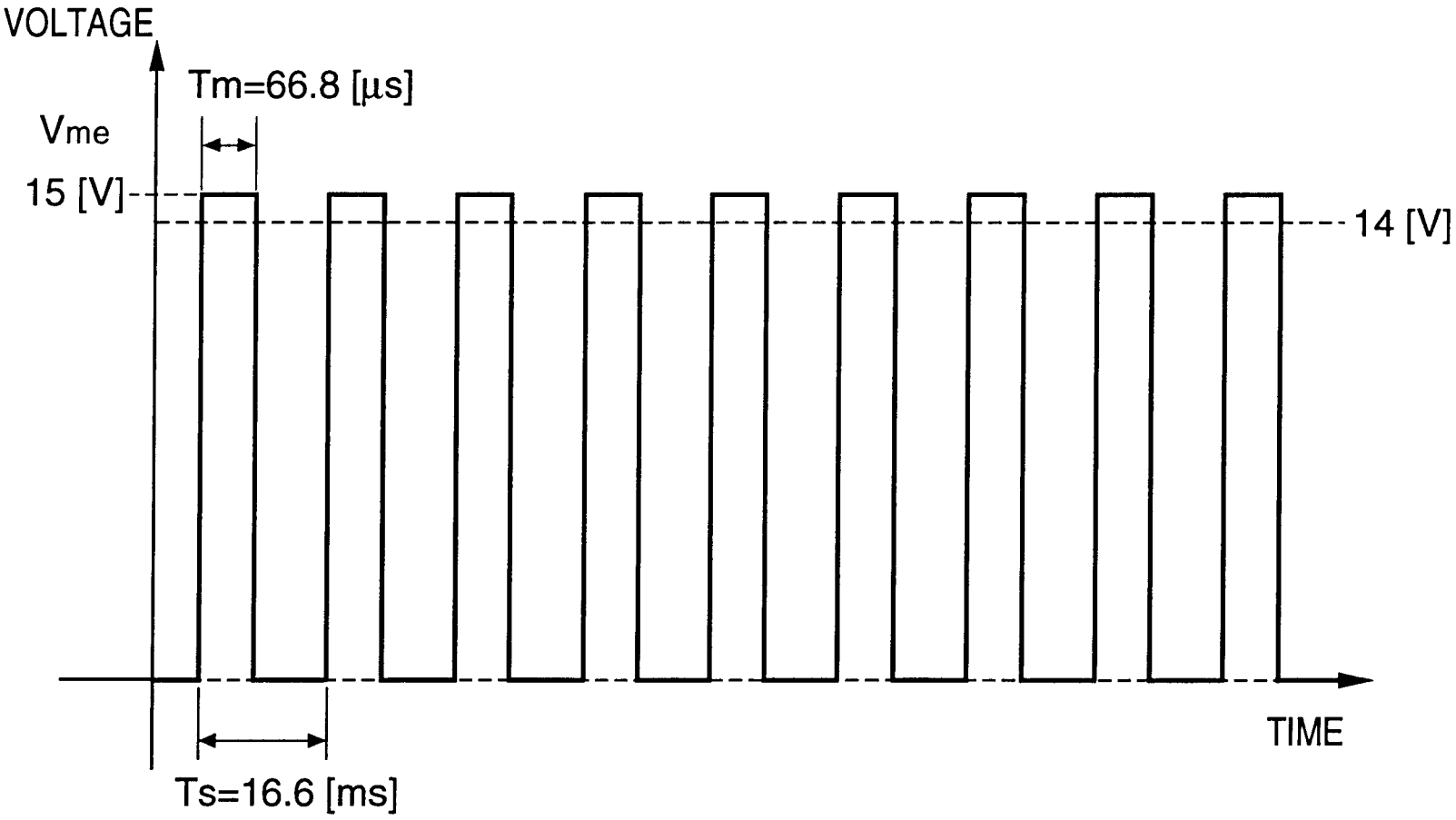
FIG. 15 is a chart showing a voltage waveform for realizing the memory function used in the first embodiment.

FIG. 15 is a chart showing the waveform of the memory voltage used in this embodiment.

Referring to FIG. 15, a peak value Vme of the memory voltage is 15 [V]. This value is determined on the basis of the driving voltage of 14 [V] while predicting an increase in driving voltage caused by noise or a temperature characteristic of the drive circuit. A pulse width Tm of the memory voltage is 66.8 [$\mu$s], and a pulse period Ts is 16.6 [ms]. Hundred pulses are applied to one device. These conditions are determined with reference to driving conditions for a general TV set. However, the characteristic can be shifted even under other conditions.

In this manner, the memory voltage is applied to the surface conduction electron-emitting device in advance, and the device characteristic is changed (shifted) and stored. With this process, the device characteristic is not newly changed in the driving operation. Therefore, unlike the prior multi-electron-beam source used for a display apparatus, the luminance of the display screen can be prevented from being decreased, and a luminance variation of the display screen can be eliminated.

Application of the memory voltage or characteristic shift voltage is performed in a vacuum atmosphere. Preferably, the partial pressure of an organic gas in the vacuum atmosphere is $1\times10^{-8}$ Torr or less. In many cases, the origin of the organic gas remaining in the vacuum atmosphere is the vapor of an oil used in the vacuum exhaust unit such as a rotary pump or an oil diffusion pump, or the residue of an organic solvent used in the manufacturing processes of the surface conduction electron-emitting device. Examples of the organic gas are aliphatic hydrocarbons such as alkane, alkene, and alkyne, aromatic hydrocarbons, alcohols, aldehydes, ketones, amines, phenols, organic acids such as carboxylic acid and sulfonic acid, or derivatives of the above-described organic substances: more specifically, butadiene, n-hexane, l-hexene, benzene, toluene, O-xylene, benzonitrile, chloroethylene, trichloroethylene, methanol, ethanol, isopropanol, formaldehyde, acetaldehyde, acetone, methyl ethyl ketone, diethyl ketone, methylamine, ethylamine, acetic acid, and propionic acid.

The arrangement of an electrical circuit for performing a display operation on the display panel manufactured in the above manner will be described below.

Figure 16:
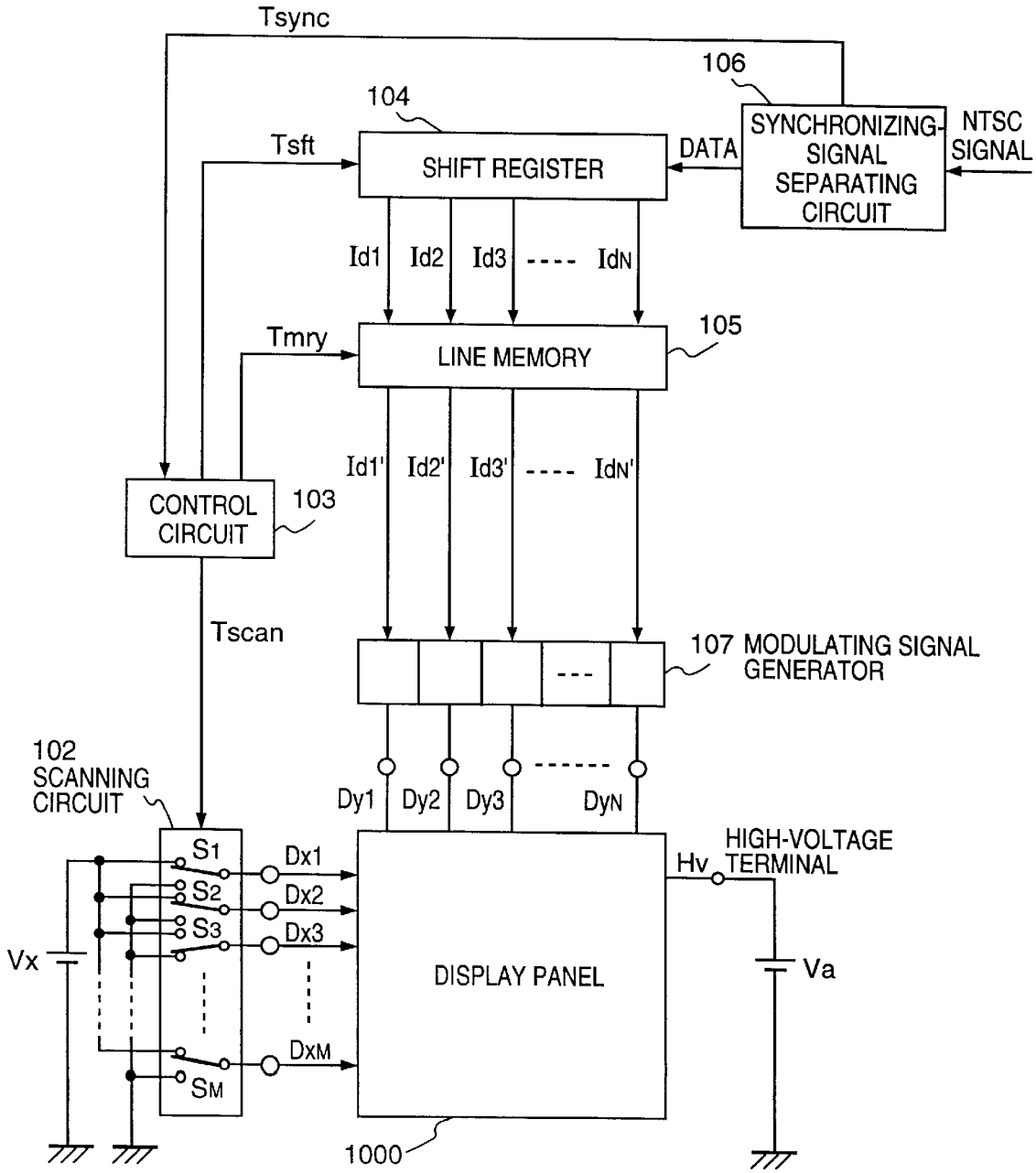
FIG. 16 is a block diagram showing the arrangement of a TV signal display circuit using the display panel of the first embodiment.

FIG. 16 is a block diagram schematically showing the arrangement of a driving circuit for performing TV display on the basis of an NTSC TV signal.

Referring to FIG. 16, reference numeral 1000 denotes the display panel; 102, a scanning circuit; 103, a control circuit; 104, a shift register; 105, a line memory; 106, a synchronizing-signal separating circuit; and 107, a modulating signal generator. Reference symbols Vx and Va denote DC voltage sources.

The functions of the respective components will be described below. The display panel 1000 is connected to an external electrical circuit through the terminals Dx1 to DxM, the terminals Dy1 to DyN, and the high-voltage terminal Hv. Scanning signals for sequentially driving the surface conduction electron-emitting device groups arranged in the multi-electron-beam source in the display panel 1000, i.e., in an M×N matrix one row (N devices) at a time are supplied to the terminals Dx1 to DxM. Modulating signals for controlling output electron beams from the respective surface conduction electron-emitting devices of one row which is selected by the scanning signal are supplied to the terminals Dy1 to DyN. A DC voltage of, e.g., 10 [kV] is applied from the DC voltage source Va to the high-voltage terminal Hv. This DC voltage is an accelerating voltage for imparting the electron beams output from the surface conduction electron-emitting devices with sufficient energy to excite the phosphors.

The scanning circuit 102 will be described next. The scanning circuit 102 incorporates M switching devices (schematically illustrated by S1 to SM in FIG. 16). Each of the switching devices selects the output voltage of the DC voltage source Vx or 0 [V] (ground level) and electrically connects the selected voltage to a corresponding one of the terminals Dx1 to DxM of the display panel 1000. The switching devices SI to SM of the scanning circuit 102 operate on the basis of a control signal Tscan output from the control circuit 103. The switching devices can be easily constituted by combining switching devices such as FETs.

The DC voltage source Vx of this embodiment is set, based on the characteristics of the surface conduction electron-emitting devices, to output a constant voltage of 7 [V].

The control circuit 103 acts to coordinate the operation of each component so as to present an appropriate display on the basis of an externally input image signal. On the basis of a synchronizing signal Tsync sent from the synchronizing-signal separating circuit 106 (to be described below), the control circuit 103 generates control signals Tscan, Tsft, and Tmry to each of the components. The timing of each control signal will be described later in detail with reference to FIG. 21.

The synchronizing-signal separating circuit 106 is a circuit for separating a synchronizing signal component and a luminance signal component from an externally input NTSC television signal. As is well known, the synchronizing-signal separating circuit 106 can be easily constituted using a frequency separating circuit (filter). The synchronizing signal separated by the synchronizing-signal separating circuit 106 comprises a vertical synchronizing signal and a horizontal synchronizing signal, as is well known. For the descriptive convenience, these signals are represented by the signal Tsync.

The luminance signal component of the image, which is separated from the TV signal, is represented by a DATA signal, for the descriptive convenience. This DATA signal is sequentially input to the shift register 104. The shift register 104 converts the DATA signal as a serial signal into a parallel signal in units of lines of the image and operates on the basis of the control signal Tsft sent from the control circuit 103. The control signal Tsft may be referred to as the shift clock of the shift register 104. The serial/parallel-converted image data of one line (corresponding to drive data of N electron-emitting devices) is output from the shift register 104 as N parallel signals Id1 to IdN.

The line memory 105 is a memory for storing one line of image data for a requisite period of time. The line memory 105 appropriately stores the contents of Id1 to IdN in accordance with the control signal Tmry sent from the control circuit 103. The contents stored in the line memory 105 are output as I'd1 to I'dN and input to the modulating signal generator 107. The modulating signal generator 107 is a signal source for appropriately modulating and driving each of the surface conduction electron-emitting devices in accordance with the image data I'd1 to I'dN. The output signals from the modulating signal generator 107 are supplied to the surface conduction electron-emitting devices in the display panel 1000 through the terminals Dy1 to DyN.

The functions of the respective components shown in FIG. 16 have been described above. Before a description of an entire operation, the operation of the display panel 1000 will be described in more detail with reference to FIGS. 17 to 20. For the illustrative convenience, the number of pixels of the display panel 1000 is set to 6×6 (i.e., M=N=6). As is apparent, however, the display panel 1000 to be actually used has a much larger number of electron-emitting devices (pixels).

Figure 17:
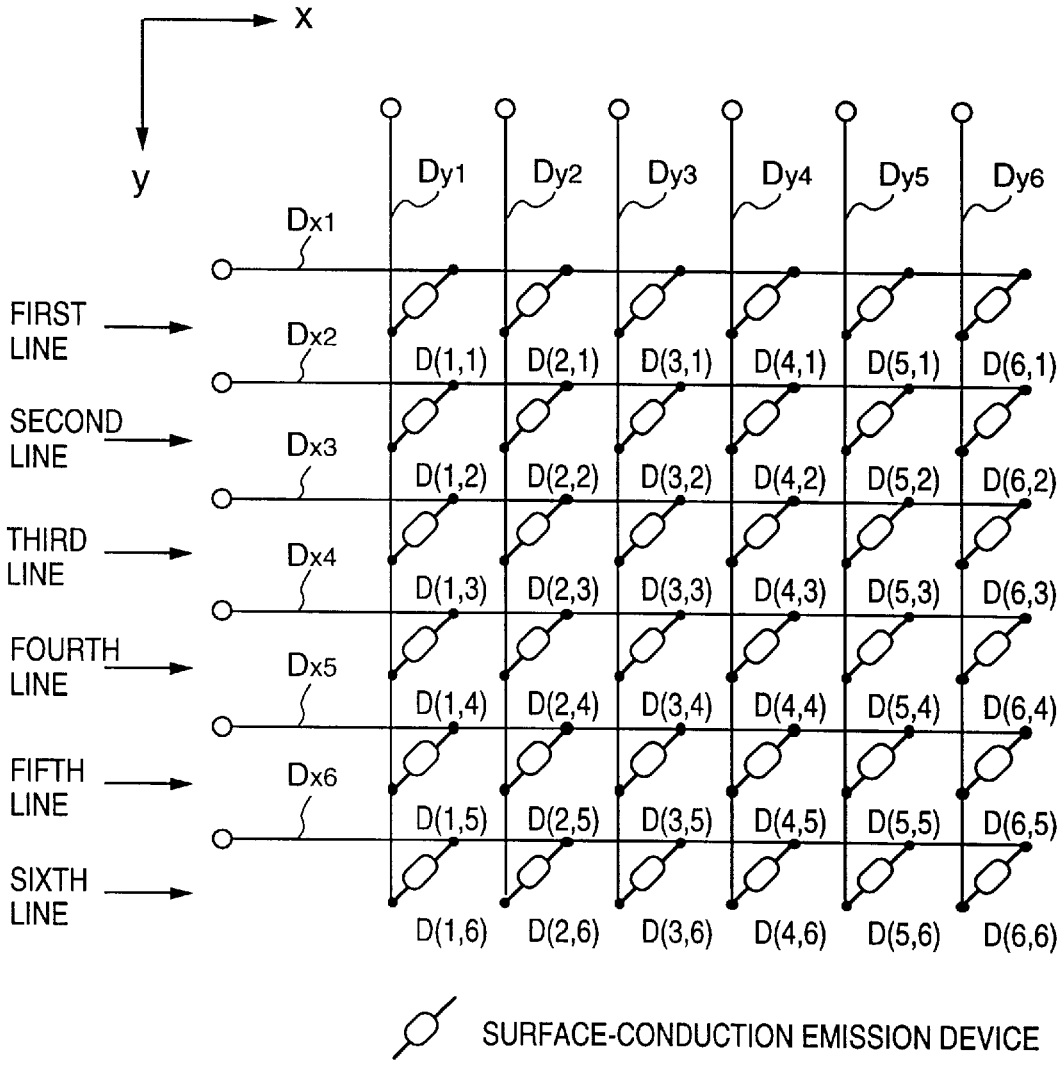
FIG. 17 is a plan view showing an example of the arrangement of the electron-emitting devices of the multi-electron-beam source of the first embodiment.

FIG. 17 is a circuit diagram showing a multi-electron-beam source in which surface conduction electron-emitting devices are wired in a 6×6 matrix. In FIG. 17, for the sake of descriptive convenience, the positions of the respective devices are represented by (X,Y) coordinates: D(1,1), D(1,2), . . . , and D(6,6).

When an image is to be displayed by driving such a multi-electron-beam source, the image is sequentially formed in units of lines (rows) parallel to the X-axis. To drive electron-emitting devices corresponding to the image of one line, of the terminals Dx1 to Dx6, the terminal of the row corresponding to the display line is applied with a voltage of 0 [V], and the remaining terminals are applied with a voltage of +7 [V]. In synchronism with this operation, modulating signals from the modulating signal generator 107 are supplied to the terminals Dy1 to Dx6 in accordance with the image pattern of the line.

Figure 18:
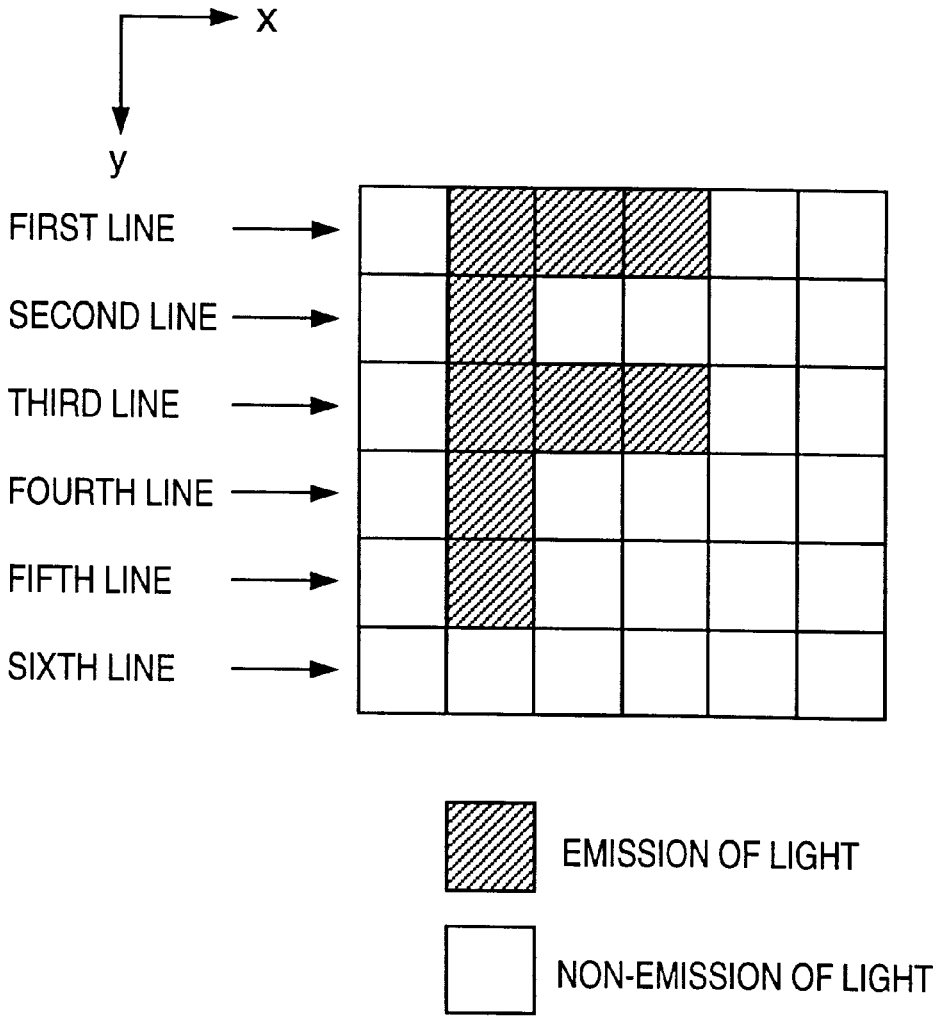
FIG. 18 is a view for explaining an example of display in units of lines in the first embodiment.

An example will be described in which an image pattern as shown in FIG. 18 is displayed. For the descriptive convenience, the luminances of the light-emitting portions of the image pattern equal each other and correspond to, e.g., 100 [ft·L]. In the display panel 1000, a known P-22 was used as a phosphor, the accelerating voltage was 10 [kV], the repeating frequency of image display was 60 [Hz], and the surface conduction electron-emitting devices having the above characteristics were used as electron-emitting devices. In this case, a voltage of 14 [V] is suitable. This voltage value changes when the respective parameters are changed.

Figure 19:
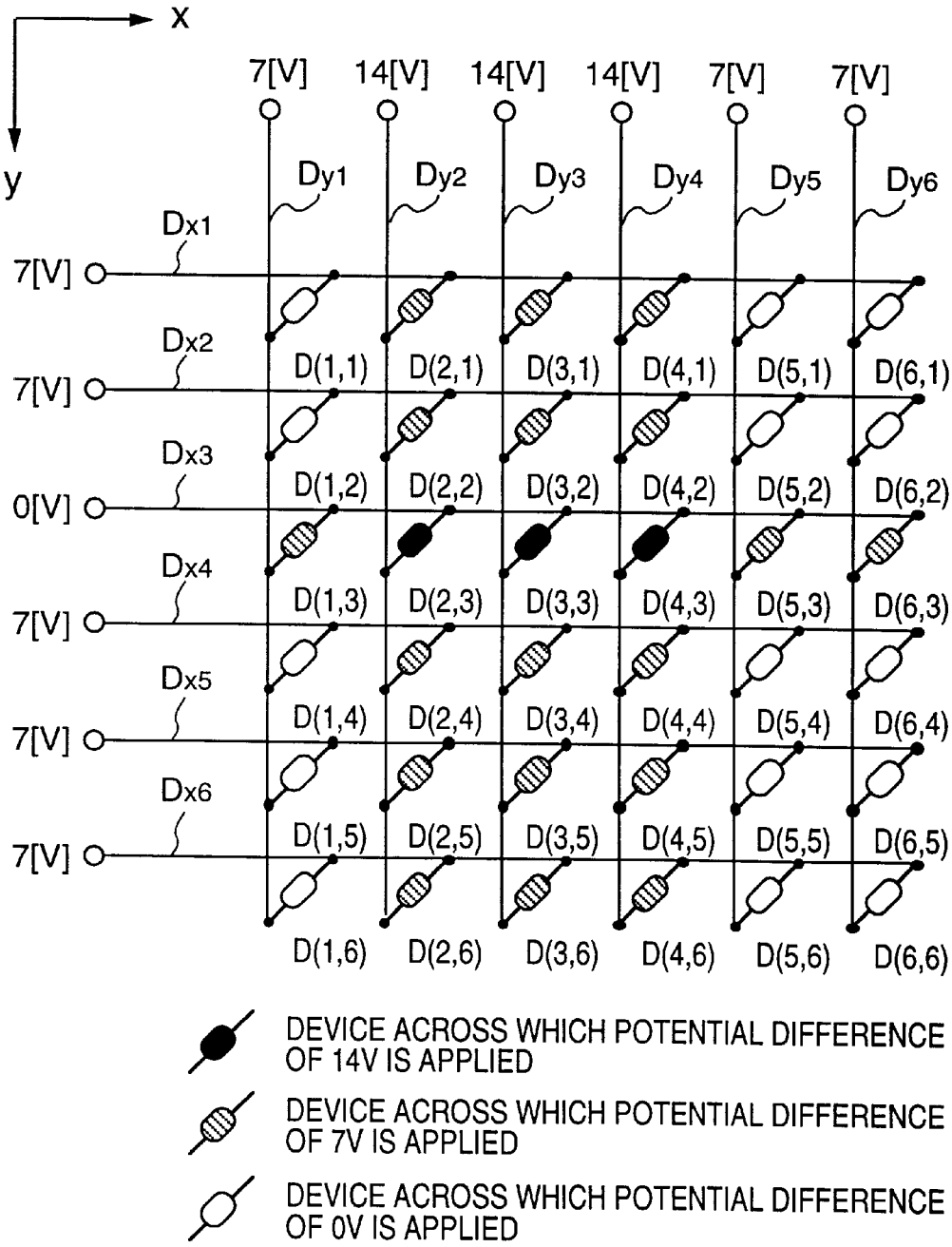
FIG. 19 is a view showing a detailed example of the display form of the circuit shown in FIG. 17.

For the image shown in FIG. 18, a period for light emission of the third line will be described. FIG. 19 is a view showing voltage values applied to the multi-electron-beam source through the terminals Dx1 to Dx6 and Dy1 to Dx6 while light is emitted from the third line of the image.

As is apparent from FIG. 19, a voltage of 14 [V] is applied between the pairs of electrode devices of the surface conduction electron-emitting devices at D(2,3), D(3,3), and D(4,3) of the third line so that electron beams are output. A voltage of +7 (=14−7) [V] (hatched devices in FIG. 19) or 0 (7−7) [V] (white devices in FIG. 19) is applied between the pairs of electrodes of the electron-emitting devices except for the above three devices. The voltage of 7 V or 0 V is equal to or lower than the electron emission threshold voltage (14 V) of the surface conduction electron-emitting devices, so no electron beams are output from these devices.

Figure 20:
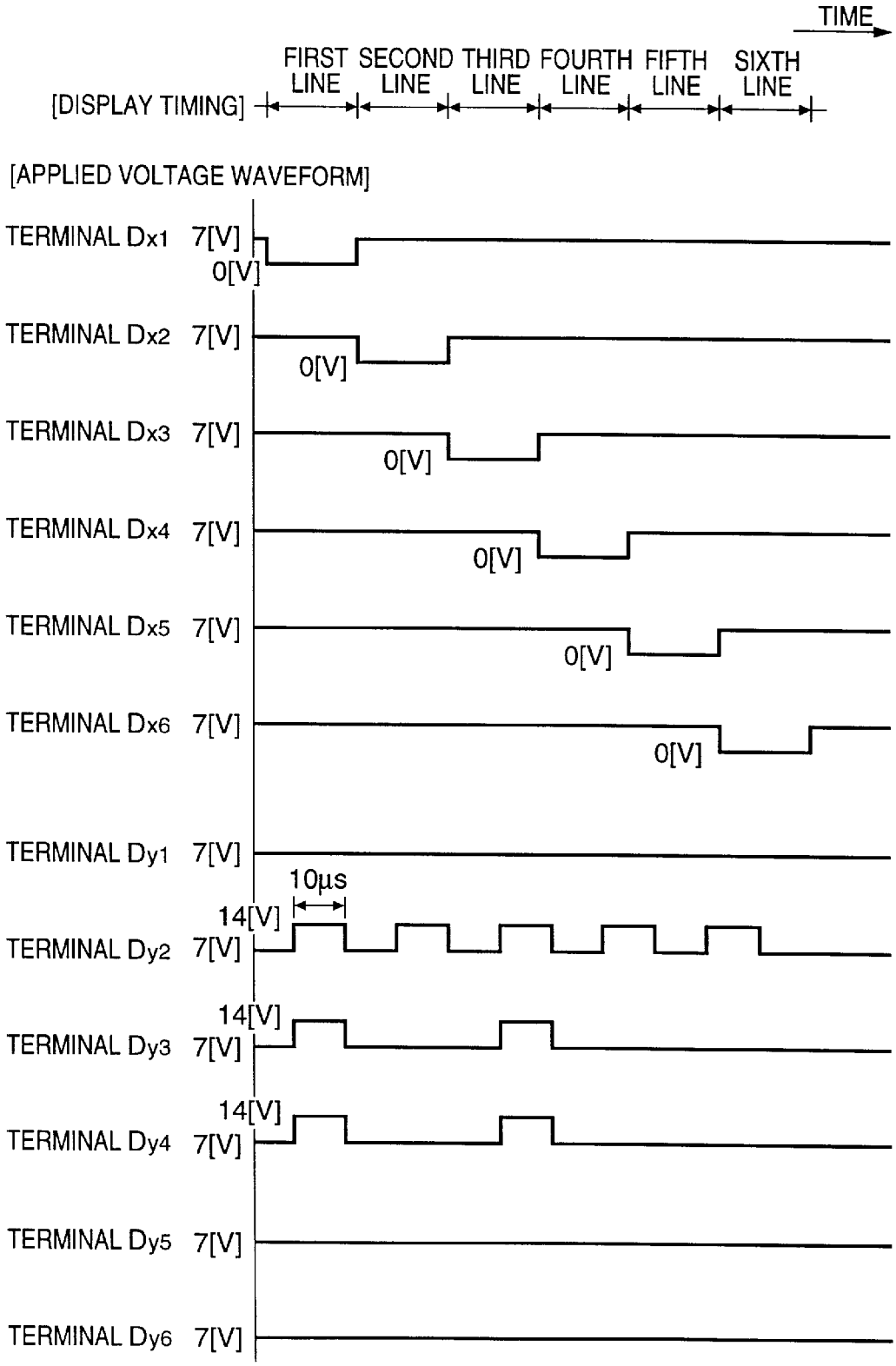
FIG. 20 is a timing chart showing a timing example of display shown in FIG. 19.
Figure 21A:
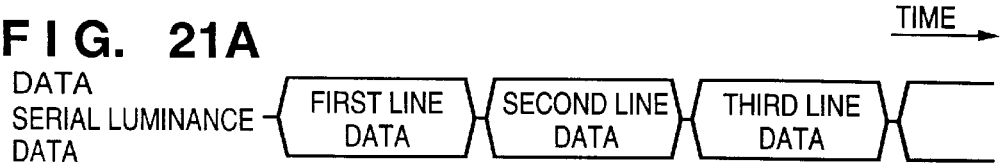
FIGS. 21A–F is a timing chart showing a timing example of display of the first embodiment.
Figure 21B:
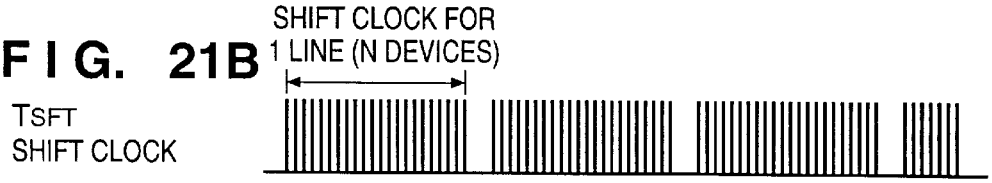
Figure 21C:
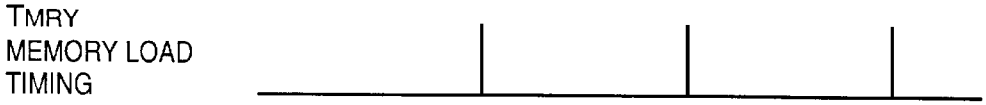
Figure 21D:
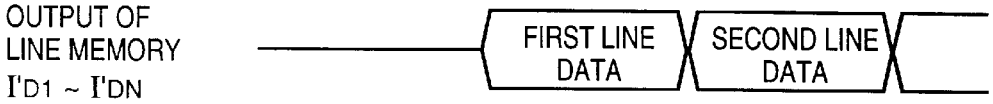
Figure 21E:
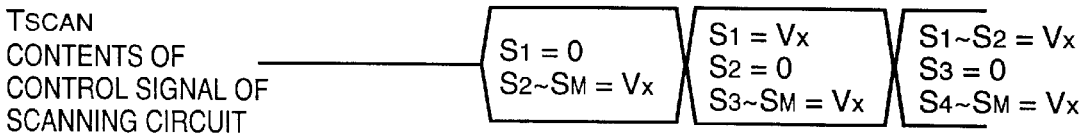
Figure 21F:
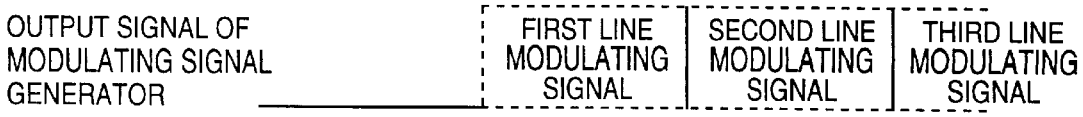

For the remaining lines as well, the multi-electron-beam source is driven in units of rows in a similar manner in accordance with the display pattern shown in FIG. 18, thereby performing the display operation. FIG. 20 is a timing chart time-serially showing this driving operation.

As shown in FIG. 20, when the multi-electron-beam source is sequentially driven from the first line, image display free from flicker can be realized. To change the light emission luminance of the display pattern, i.e., to increase (reduce) the luminance, the length of the pulse of the modulating signal applied to the terminals Dy1 to Dx6 is made larger (smaller). With this operation, modulation is enabled.

The method of driving the display panel 1000 using the multi-electron-beam source with 6×6 pixels has been described above. The entire operation of the apparatus shown in FIG. 16 will be described below with reference to the timing chart of FIG. 21.

Referring to FIG. 21, (1) represents the timing of the luminance signal DATA separated from the externally input NTSC signal by the synchronizing-signal separating circuit 106. As shown in FIG. 21, the DATA signal is sequentially sent in the order of the first line, the second line, the third line, . . . . In synchronism with this operation, the shift clock Tsft is output from the control circuit 103 to the shift register 104, as represented by (2) in FIG. 21. When the image data of one line is accumulated in the shift register 104 in synchronism with the shift clock Tsft, the memory write signal Tmry is output from the control circuit 103 to the line memory 105 at a timing represented by (3) in FIG. 21, so that the image data of one line (N devices) is stored in the line memory 105 and held. As a result, the contents of I'd1 to I'dN as output signals from the line memory 105 are changed at timing (4) in FIG. 21.

On the other hand, the contents of the control signal Tscan for controlling the operation of the scanning circuit 102 are represented by timing (5) in FIG. 21. More specifically, when the first line is to be driven, only the switching device S1 in the scanning circuit 102 is applied with the voltage of 0 [V], and the remaining switching devices are applied with the voltage of 7 [V]. When the second line is to be driven, only the switching device S2 is applied with the voltage of 0 [V], and the remaining switching devices are applied with the voltage of 7 [V]. This applies to all the lines, and the operation is controlled. In synchronism with this operation, a modulating signal corresponding to each line is output from the modulating signal generator 107 to the display panel 1000 at timing (6) in FIG. 21.

Although not particularly specified in the above description, the shift register 104 and the line memory 105 can be either of a digital signal type or of an analog signal type as long as serial/parallel conversion or storage of the image signal is performed at a predetermined speed and timing. In the case of a digital signal type, the output signal DATA from the synchronizing-signal separating circuit 106 must be converted into a digital signal. This processing can be easily realized by arranging an A/D converter at the output portion of the synchronizing-signal separating circuit 106.

With the above-described operation, TV display is enabled using the display panel 1000.

Second Embodiment

Figure 22:
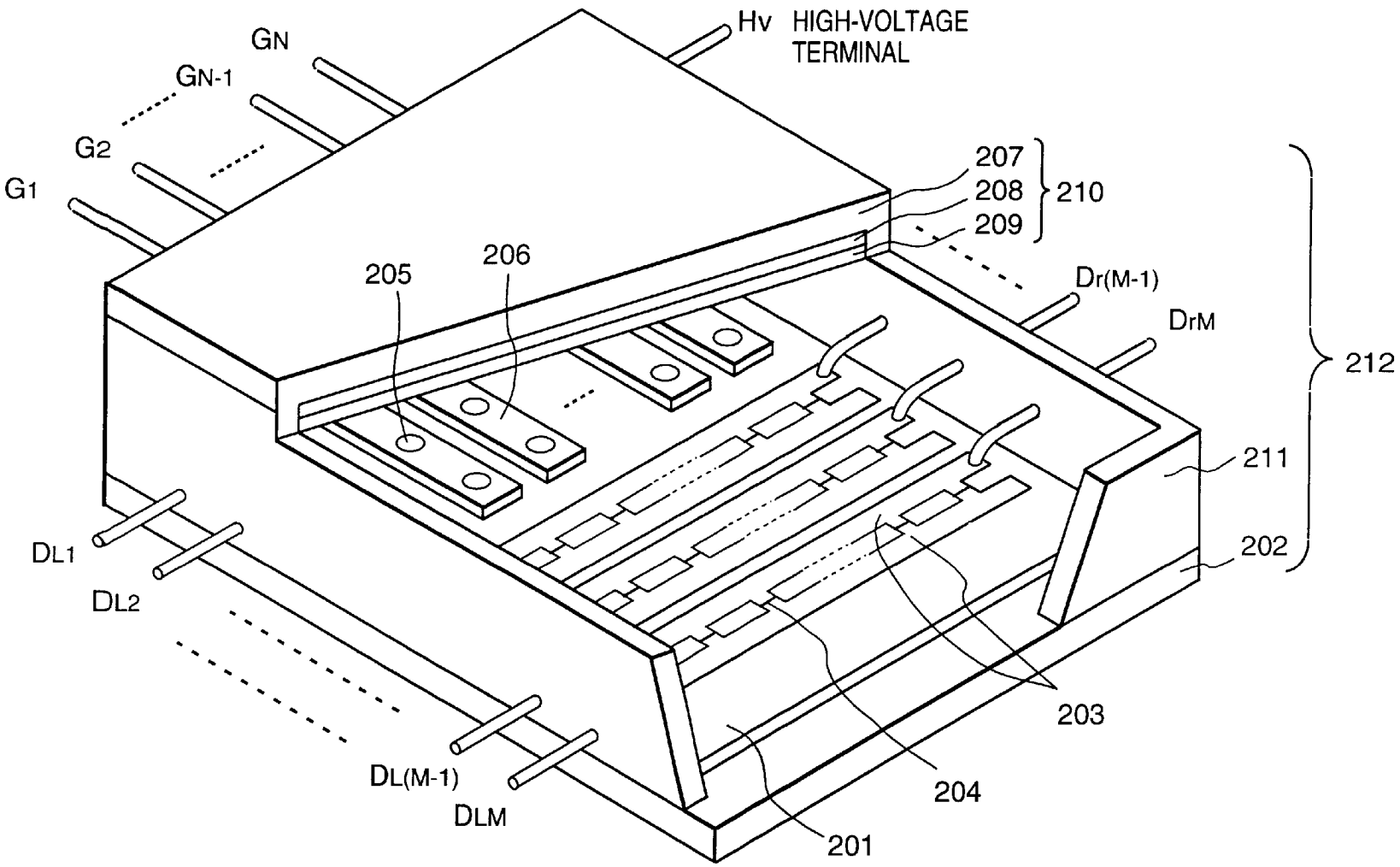
FIG. 22 is a partial cutaway perspective view showing a display panel according to the second embodiment of the present invention.

FIG. 22 is a partially cutaway perspective view showing a typical arrangement of a color image display apparatus according to the second embodiment of the present invention.

Referring to FIG. 22, a large number of emission devices are parallelly arranged on a substrate 201 (e.g., Japanese Patent Laid-Open No. 1-31332 filed by the present applicant). Two ends of each emission device are connected by wiring layers, and the substrate 201 having a lot of such rows is fixed on a rear plate 202. Thereafter, grids 206 each having electron pass holes 205 are arranged above the substrate 201 to be perpendicular to the aligning direction of the electron-emitting devices. A face plate 210 (constituted by forming a phosphor film 208 and a metal back 209 on the inner surface of a glass substrate 207) is arranged at a portion about 5 mm above the substrate 201 through a supporting frame 211. Frit glass is applied to the junction portions of the face plate 210, the supporting frame 211, and the rear plate 202 and sintered at about 400° C. to 500° C. in air or a nitrogen atmosphere for 10 minutes or more, thereby seal-connecting the parts. The rear plate 202 is also fixed to the substrate 201 with frit grass.

Referring to FIG. 22, reference numeral 204 denotes an electron-emitting portion. In this embodiment, as described above, the face plate 210, the supporting frame 211, and the rear plate 202 form an envelope 212. The rear plate 202 is arranged mainly for the purpose of reinforcing the substrate 201. If the substrate 201 itself has a sufficient strength, the rear plate 202 can be omitted. In this case, the supporting frame 211 may be directly sealed to the substrate 201, and the envelope 212 may be constituted by the face plate 210, the supporting frame 211, and the substrate 201.

The phosphor film 208 of the face plate 210 is formed by a black conductive material 213 called black stripes (FIG. 5A) and phosphors 214. The purpose of providing the black stripes is to make color mixing and the like less conspicuous by blacking the coated portions between the phosphors, which are phosphors of the three primary colors necessary for a color display, and to suppress a decline in contrast caused by reflection of external light at the phosphor film 208. In this embodiment, striped phosphors (FIG. 5A) are employed and arranged along the aligning direction of the electron-emitting devices (i.e., in a direction perpendicular to the grids 206). The black stripes are formed in advance, and the respective color phosphors are applied between the black stripes, thereby forming the phosphor film 208.

A substance whose principal ingredient is popular graphite is used as the material constituting the black stripes, and any material may be used so long as it is electrically conductive and allows but little light to pass through or to be reflected. As for the methods of coating the glass substrate 207 with the phosphor, a precipitation method or printing method is used for a monochromatic display. In this embodiment, however, a slurry method is used for a color display. Even when a printing method is used for a color display, a similar coating film can be obtained, as a matter of course.

The metal back 209 is normally provided on the inner surface of the phosphor film 208. The purpose of providing the metal back 209 is to increase the luminance by mirror-reflecting, to the face plate 210 side, part of light emitted from the phosphor and propagating toward the inner surface, to use the metal back 209 as an electrode for applying an electron beam accelerating voltage, to protect the phosphor from damage by collision with negative ions generated in the envelope 212, and the like. The metal back 209 is formed by forming the phosphor film 208, applying a smoothing process (normally called filming) to the inner surface of the phosphor film 208, and depositing aluminum (Al) thereon by vacuum deposition. To increase the conductivity of the phosphor film 208, a transparent electrode (not shown) is sometimes formed on the outer surface of the phosphor film 208. In this embodiment, the transparent electrode is omitted because the metal back 209 suffices to obtain a sufficient conductivity. In seal-connecting the junction portions of the face plate 210, the supporting frame 211, and the rear plate 202, sufficient positioning is carried out because the phosphors 214 of the respective colors and electron-emitting devices 110 must be made correspond for a color display.

The glass vessel formed in the above manner is evacuated by a vacuum pump through an exhaust pipe (not shown). After achieving a sufficient vacuum, a voltage is applied between device electrodes 203 through external terminals Dr1 to DrM and DL1 to DLM, thereby performing the energization forming process. With this process, the electron-emitting portions 204 are formed, and the electron-emitting devices 204 are formed on the substrate 201. The exhaust pipe (not shown) is heated by a gas burner in a vacuum atmosphere of about $10^{-6}$ Torr to weld the exhaust pipe, thereby sealing the envelope 212. Finally, a getter process is performed to maintain the vacuum after sealing. This is a process of, immediately before/after sealing, forming a deposition film by heating a getter film at a predetermined position (not shown) in the image display apparatus by resistance heating or RF heating. The getter film mainly consists of Ba. The adsorption effect of the deposition film maintains the vacuum.

In the image display apparatus formed in the above manner, voltages are applied to the electron-emitting devices through the external terminals Dr1 to DrM and DL1 to DLM, thereby causing the respective electron-emitting portions 204 to emit electrons. The emitted electrons pass through the electron pass holes of the modulating electrodes 206 and are accelerated by a high voltage of several kV or more, which is applied to a metal back 209 or a transparent electrode (not shown) through a high-voltage terminal Hv, so that the electrons are bombarded against the phosphor film 208. With this operation, the phosphors are excited to emit light. When a voltage according to image data is applied to the modulating electrodes 206 through external terminals G1 to GN, the electron beams passing through the electron pass holes are controlled to display an image.

In this embodiment, the modulating electrodes 206 each having the electron pass holes 205 with a diameter of almost 50 $\mu$m are arranged almost 10 $\mu$m above the substrate 201 through an $SiO_2$ layer (not shown) serving as an insulating layer. When an accelerating voltage of 6 kV is applied, ON/OFF of an electron beam can be controlled by a modulating voltage of 50 V or less.

Figure 23:
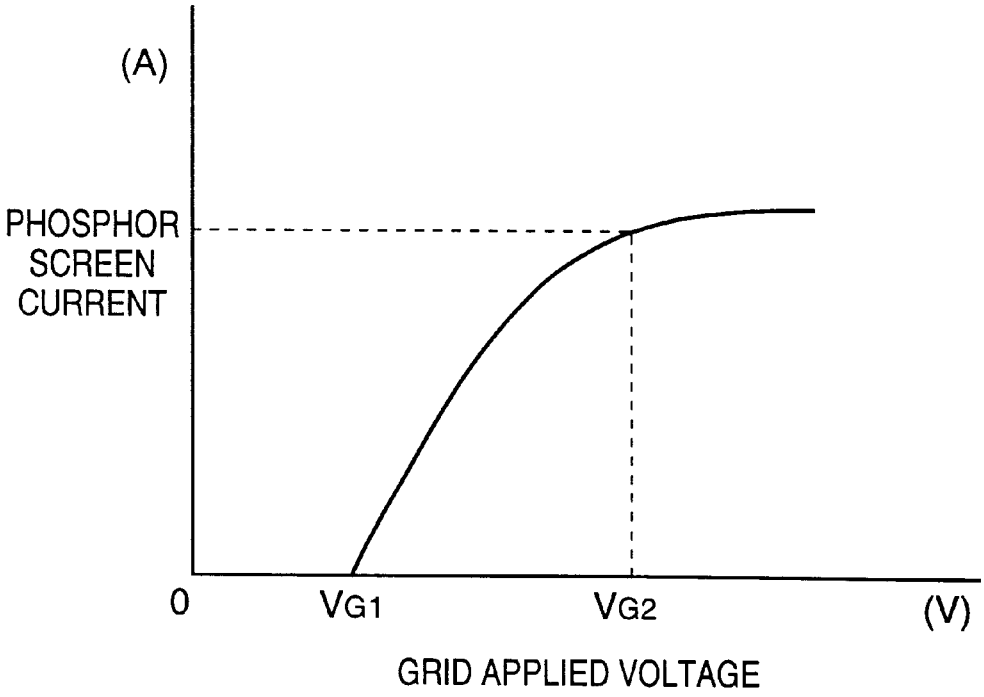
FIG. 23 is a graph showing the relationship between a grid applied voltage and a current value on a phosphor surface in the second embodiment.

FIG. 23 is a graph showing the relationship between a grid voltage $V_G$ applied to the modulating electrodes 206 and the phosphor surface current flowing to the phosphor film 208. As the grid voltage $V_G$ is increased to a certain threshold voltage VG1 or more, the phosphor surface current starts to flow. When the grid voltage $V_G$ is further increased, the phosphor surface current monotonously increases and is saturated eventually at a grid voltage VG2 or more, as shown in FIG. 23.

The above-described arrangement is necessary for manufacturing an image display apparatus, though the details including the materials of the respective members are not limited to those described above, and can appropriately selected in accordance with the application purpose of the image display apparatus.

The basic arrangement and manufacturing method of the display panel of the second embodiment have been described above. In the second embodiment as well, a memory voltage is applied to the surface conduction electron-emitting device, so that the characteristic is shifted to the noise safety region before the driving operation. The conditions such as a vacuum atmosphere and the like at this time are the same as those in the first embodiment.

The display panel manufactured by the above process was connected to a driving circuit for TV display and driven. Unlike the prior art, an abrupt change in display luminance caused by a change in characteristics of the surface conduction electron-emitting devices was not observed.

As for the main arrangement of the driving circuit of the second embodiment, an output voltage from a modulating signal generator is set to a voltage suitable for modulation by the grids and connected to the terminals G1 to GN. The output voltage from a scanning circuit 102 is set such that the scanning voltage=14.0 [V] and the non-scanning voltage=0 [V], and connected to the terminals DL1 to DLM. The terminals Dr1 to DrM are always set at 0 [V].

Application Example

Figure 24:
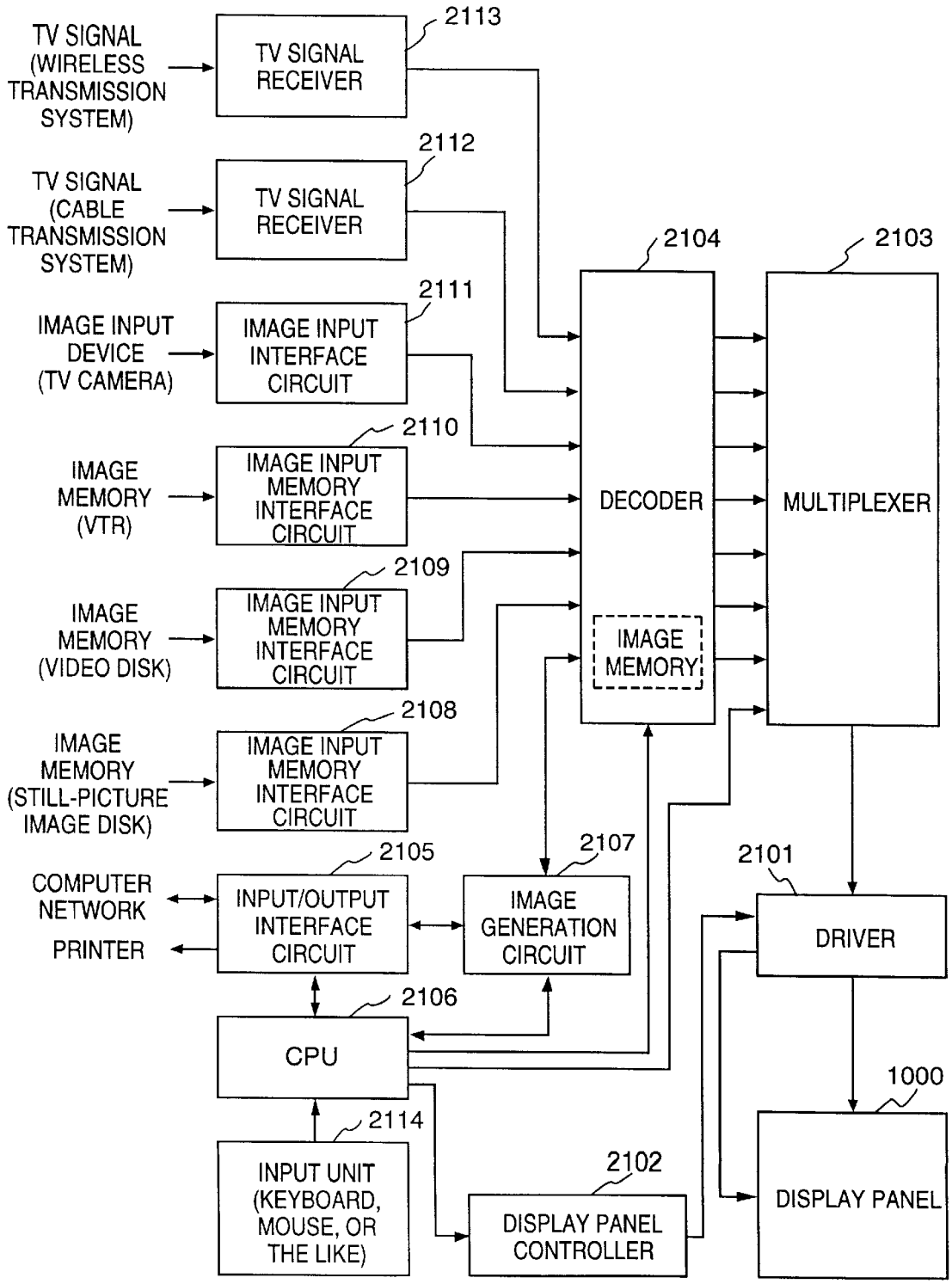
FIG. 24 is a block diagram of a multifunctional image display apparatus using an image display apparatus of the present invention.
Figure 25:
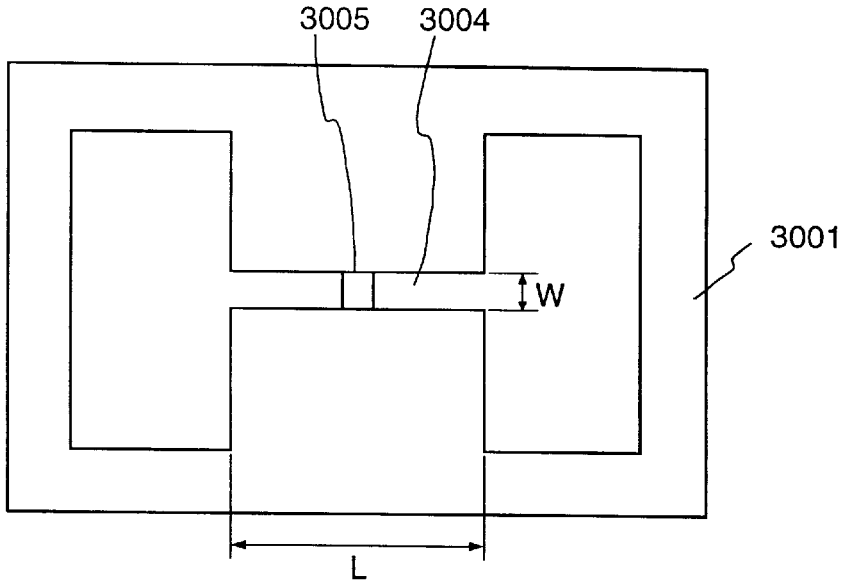
FIG. 25 is a plan view showing an example of a conventional surface conduction electron-emitting device.
Figure 26:
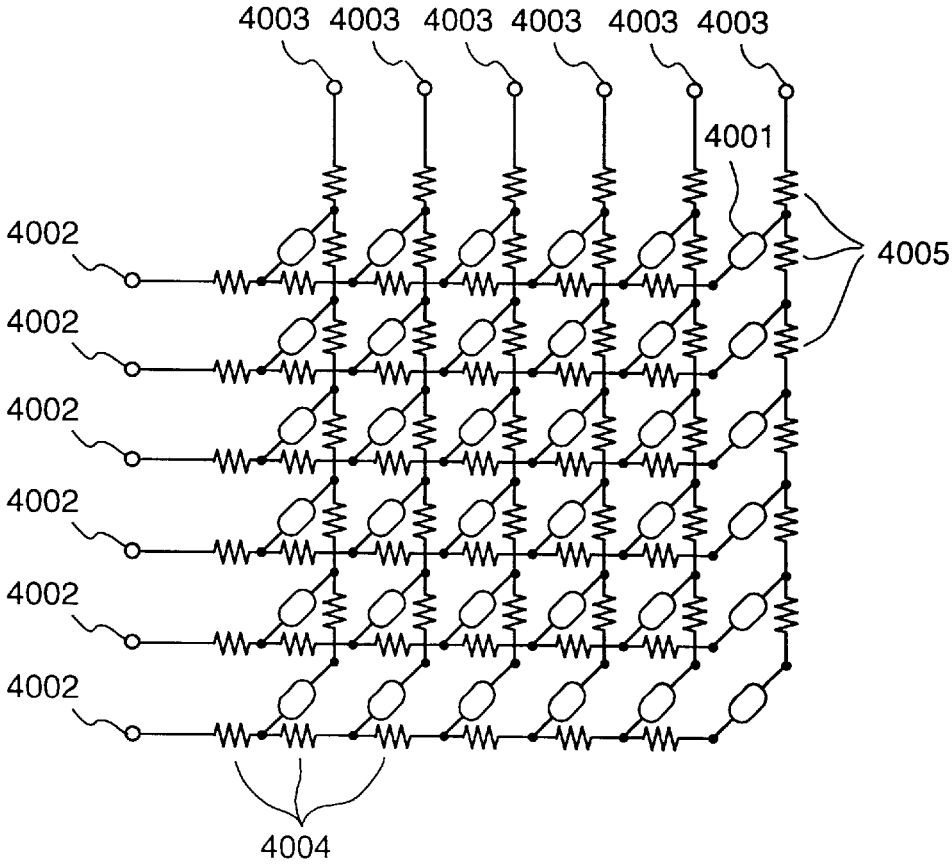
FIG. 26 is a view for explaining the general matrix wiring of electron-emitting devices.

FIG. 24 is a block diagram showing an example of a multifunction display apparatus capable of displaying image information supplied from various image information sources such as TV broadcasting on a display panel 1000 using surface conduction electron-emitting devices as electron-emitting devices. A display panel 1000 provides a surface conduction electron-emitting device of which electron-emitting characteristic is shifted in advance as described in the first and second embodiments.

Referring to FIG. 24, reference numeral 1000 denotes the display panel; 2101, a driver of the display panel; 2102, a display panel controller; 2103, a multiplexer; 2104, a decoder; 2105, an input/output interface circuit; 2106, a CPU; 2107, an image generator; 2108 to 2110; image memory interface circuits, 2111, an image input interface circuit; 2112 and 2113, TV signal receivers; and 2114, an input unit.

When the display apparatus of this example receives a signal such as a TV signal including both video information and audio information, video images and sound are reproduced simultaneously, as a matter of course. A description of circuits and speakers which are associated with reception, separation, processing, and storage of audio information will be omitted because these components are not directly related to the feature of the present invention. The functions of the respective components will be described below in accordance with the flow of an image signal.

The TV signal receiver 2113 is a circuit for receiving TV image signals transmitted via a wireless transmission system such as electric wave transmission or space optical communication. The standards of the TV signals to be received are not particularly limited, and any one of the NTSC, PAL, and SECAM standards may be used. In addition, a TV signal comprising a larger number of scanning lines (e.g., a signal for a so-called high-definition TV represented by the MUSE standard) is a preferable signal source for utilizing the advantageous features of the display panel applicable to a large display screen and numerous pixels. The TV signal received by the TV signal receiver 2113 is output to the decoder 2104.

The TV signal receiver 2112 is a circuit for receiving TV image signals transmitted via a cable transmission system such as a coaxial cable system or an optical fiber system. Like the TV signal receiver 2113, the standards of the TV signals to be received are not particularly limited. The TV signal received by the TV signal receiver 2112 is also output to the decoder 2104. The image input interface circuit 2111 is a circuit for receiving an image signal supplied from an image input device such as a TV camera or an image reading scanner. The received image signal is output to the decoder 2104.

The image memory interface circuit 2110 is a circuit for receiving an image signal stored in a video tape recorder (to be abbreviated as a VTR hereinafter). The received image signal is output to the decoder 2104. The image memory interface circuit 2109 is a circuit for receiving an image signal stored in a video disk. The received image signal is output to the decoder 2104. The image memory interface circuit 2108 is a circuit for receiving an image signal from a device such as a still-picture image disk which stores still-picture image data. The received still-picture image data is output to the decoder 2104. The input/output interface circuit 2105 is a circuit for connecting the display apparatus of this example to an external computer, a computer network, or an output device such as a printer. The input/output interface circuit 2105 not only inputs/outputs image data or character data/graphic information but also can input/output control signals or numerical data between the CPU 2106 of the image forming apparatus and an external device, as needed.

The image generator 2107 is a circuit for generating display image data on the basis of image data or character/ graphic information externally input through the input/output interface circuit 2105 or image data or character/graphic information output from the CPU 2106. This circuit incorporates circuits necessary for generating image data, including a reloadable memory for accumulating image data or character/graphic information, a read only memory which stores image patterns corresponding to character codes, and a processor for performing image processing. The display image data generated by this circuit is output to the decoder 2104. However, the display image data can be output to an external computer network or a printer through the input/output interface circuit 2105, as needed.

The CPU 2106 mainly performs an operation associated with operation control of the display apparatus, and generation, selection, and editing of a display image. For example, a control signal is output to the multiplexer 2103, thereby appropriately selecting or combining image signals to be displayed on the display panel. At this time, a control signal is generated to the display controller 2102 in accordance with the image signal to be displayed, thereby appropriately controlling the operation of the display panel, including the frame display frequency, the scanning method (e.g., interlaced scanning or non-interlaced scanning), and the number of scanning lines in one frame. In addition, the CPU 2106 directly outputs image data or character/graphic information to the image generator 2107, or accesses an external computer or memory through the input/output interface circuit 2105 to input image data or character/graphic information.

The CPU 2106 may operate for other purposes. For example, the CPU 2106 may be directly associated with a function of generating or processing information, like a personal computer or a wordprocessor. Alternatively, as described above, the CPU 2106 may be connected to an external computer network through the input/output interface circuit 2105 to cooperate with the external device in, e.g., numerical calculation.

The input unit 2114 is used by the user to input instructions, program, or data to the CPU 2106. In addition to a keyboard and a mouse, various input devices such as a joy stick, a bar-code reader, or a speech recognition device can be used.

The decoder 2104 is a circuit for reversely converting various image signals input from the circuits 2107 to 2113 into three primary color signals, or a luminance signal and I and Q signals. As indicated by a dotted line in FIG. 24, the decoder 2104 preferably incorporates an image memory such that TV signals such as MUSE signals which require an image memory for reverse conversion can be processed. An image memory facilitates display of a still-picture image. In addition, the image memory enables facilitation of image processing including thinning, interpolation, enlargement, reduction, and synthesizing, and editing of image data in cooperation with the image generators 2107 and 2106. The multiplexer 2103 appropriately selects a display image on the basis of a control signal input from the CPU 2106. More specifically, the multiplexer 2103 selects a desired image signal from the reverse-converted image signals input from the decoder 2104 and outputs the selected image signal to the driver 2101. In this case, the multiplexer 2103 can realize so-called multiwindow television, where the screen is divided into a plurality of areas to display a plurality of images in the respective areas, by selectively switching image signals within a display period for one frame. The display controller 2102 is a circuit for controlling the operation of the driver 2101 on the basis of a control signal input from the CPU 2106.

For the basic operation of the display panel, the display controller 2102 outputs a signal for controlling the operation sequence of the driving power supply (not shown) of the display panel to the driver 2101. For the method of driving the display panel, the display controller 2102 outputs a signal for controlling the frame display frequency or the scanning method (e.g., interlaced scanning or non-interlaced scanning) to the driver 2101. The display panel controller 2102 outputs a control signal associated with adjustment of the image quality including the luminance, contrast, color tone, and sharpness of a display image to the driver 2101, as needed.

The driver 2101 is a circuit for generating a driving signal to be supplied to the display panel 1000. The driver 2101 operates on the basis of an image signal input from the multiplexer 2103 and a control signal input from the display panel controller 2102.

The functions of the respective components have been described above. In this example, the display apparatus having the arrangement shown in FIG. 24 can display, on the display panel 1000, image information input from various image information sources. More specifically, various image signals including TV broadcasting signals are subjected to reverse conversion by the decoder 2104, appropriately selected by the multiplexer 2103, and input to the driver 2101.

The display panel controller 2102 generates a control signal for controlling the operation of the driver 2101 in accordance with the image signal to be displayed. The driver 2101 supplies a driving signal to the display panel 1000 on the basis of the image signal and the control signal. With this operation, an image is displayed on the display panel 1000. The series of operations are integrally controlled by the CPU 2106.

This display apparatus of this example not only displays image data selected from a plurality of image information in association with the image memory incorporated in the decoder 2104, the image generator 2107, and the CPU 2106, but also can perform, for image information to be displayed, image processing including enlargement, reduction, rotation, movement, edge emphasis, thinning, interpolation, color conversion, and aspect ratio conversion, and image editing including synthesizing, deletion, combining, replacement, and insertion. Though not particularly referred to in the description of this example, circuits dedicated to processing and editing of audio information may be arranged, as for image processing and image editing.

The display apparatus of this example can realize function of various devices, e.g., a TV broadcasting display device, a teleconference terminal device, an image editing device for still-pictures and moving pictures, an office-work terminal device such as a computer terminal or a wordprocessor, a game machine, and the like. Therefore, the display apparatus has a wide application range for industrial and private use.

FIG. 24 only shows an example of the arrangement of the display apparatus using the display panel in which surface conduction electron-emitting devices are used as an electron source, and the display apparatus is not limited to this arrangement, as a matter of course. For example, of the constituent elements shown in FIG. 24, circuits associated with functions unnecessary for the application purpose can be omitted. Reversely, constituent elements can be added in accordance with the application purpose. When the display apparatus of this example is to be used as a visual telephone, preferably, a TV camera, a microphone, an illumination device, a transmission/reception circuit including a modem may be added.

Since display apparatus of this example uses, as its electron source, surface conduction electron-emitting devices, a low-profile display panel can be realized, so that the depth of the display apparatus can be reduced. In addition, since the display panel using surface conduction electron-emitting devices as the electron source can be easily enlarged, and it has a high luminance and a wide view angle, the image forming apparatus can display vivid images with realism and impressiveness.

The present invention can be applied to a system constituted by a plurality of devices such as a host computer, an interface, and a printer, or to an apparatus comprising a single device. Furthermore, the present invention is applicable also to a case where the invention is realized by supplying a program to a system or apparatus. In this case, a memory medium storing the program according to the present invention constitutes the invention. The system or apparatus is operated in a manner defined in advance by reading out the program from the memory medium to the system or apparatus.

As has been described above, according to the present invention, a decrease in luminance during the driving operation or a luminance variation, which is caused when the multi-electron-beam source using the surface conduction electron-emitting devices is applied to an image display apparatus, can be prevented.

As many apparently widely different embodiments of the present invention can be made without departing from the spirit and scope thereof, it is to be understood that the invention is not limited to the specific embodiments thereof except as defined in the appended claims.

What is claimed is:

1. A method of manufacturing an electron generating apparatus having a multi-electron-beam source in which a plurality of surface conduction electron-emitting devices are arranged, and driving means for applying a driving voltage to said multi-electron-beam source on the basis of an input image signal, comprising the steps of:

forming an electron emitting portion of each of the plurality of surface conduction electron-emitting devices; and applying a characteristic shift voltage having a value larger than a voltage value corresponding to a sum of a maximum value of the driving voltage and a noise voltage generated by said driving means to the electron emitting portion of each of said plurality of surface conduction electron-emitting devices, after the electron emitting portions of said plurality of surface conduction electron-emitting devices have been formed.

2. The method according to claim 1, wherein the characteristic shift voltage is applied in an atmosphere in which a partial pressure of an organic gas is not more than $10^{-8}$ Torr.

3. The method according to claim 1, wherein the characteristic shift voltage is 1.05 to 1.5 times the maximum value of the driving voltage.

4. A method of manufacturing an image forming apparatus having an electron generating apparatus, and a phosphor which is excited and emits light upon irradiation of an electron beam, wherein said electron generating apparatus having a multi-electron-beam source in which a plurality of surface conduction electron-emitting devices are arranged and driving means for applying a driving voltage to said multi-electron-beam source on the basis of an input image signal, the method comprising the steps of:

forming an electron in rotary of each of the plurality of surface conduction electron-emitting devices; and applying a characteristic shift voltage having a value larger than a voltage value corresponding to a sum of a maximum value of the driving voltage and a noise voltage generated by said driving means to the electron emitting portion of each of said plurality of surface conduction portions of said plurality of surface conduction electron-emitting devices have been formed.

5. A method of adjusting an electron generating apparatus having a multi-electron-beam source in which a plurality of surface conduction electron-emitting devices are arranged, and driving means for applying a driving voltage to said multi-electron-beam source on the basis of an input image signal, comprising the step of:

applying a characteristic shift voltage having a value larger than a voltage value corresponding to a sum of a maximum value of the driving voltage and a noise voltage generated by said driving means to said plurality of surface conduction electron-emitting devices, before the driving voltage is applied.

6. The method according to claim 5, wherein the characteristic shift voltage is applied in an atmosphere in which a partial pressure of an organic gas is not more than $10^{-8}$ Torr.

7. The method according to claim 5, wherein the characteristic shift voltage is 1.05 to 1.5 times the maximum value of the driving voltage.

8. A method of adjusting an image forming apparatus having an electron generating apparatus, and a phosphor which is excited and emits light upon irradiation of an electron beam, wherein said electron generating apparatus having a multi-electron-beam source in which a plurality of surface conduction electron-emitting devices are arranged, and driving means for applying a driving voltage to said multi-electron-beam source on the basis of an input image signal, comprising the step of:

applying a characteristic shift voltage having a value larder than a voltage value corresponding to a sum of a maximum value of the driving voltage and a noise voltage generated by said driving means to said plurality of surface conduction electron-emitting device, before the driving voltage is applied.

9. A method of adjusting an image forming apparatus having an electron generating apparatus, and a phosphor which is excited and emits light upon irradiation of an electron beam, wherein said electron generating apparatus having a multi-electron-beam source in which a plurality of surface conduct on electron-emitting devices are arranged and driving means for applying a driving voltage to said multi-electron-beam-source on the basis of an input image signal, comprising the step of:

applying a characteristic shift voltage having a value larger than a voltage value corresponding to a sum of a maximum value of the driving voltage and a noise voltage generated by said driving means to said plurality of surface conduction electron-emitting devices, before the driving voltage is applied, wherein the characteristic shift voltage is applied in an atmosphere in which a partial pressure of an organic gas is not more than $10^{-8}$ Torr.

10. A method of adjusting an image forming apparatus having an electron generating apparatus, and a phosphor which is excited and emits light upon irradiation of an electron beam, wherein said electron generating apparatus having a multi-electron beam source in which a plurality of surface conduction electron-emitting devices are arranged, and driving means for applying a driving voltage to said multi-electron beam source on the basis of an input image signal, comprising the step of:

applying a characteristic shift voltage having a value larger than a voltage value corresponding to a sum of a maximum value of the driving voltage and a noise voltage generated by said driving means to said plurality of surface conduction electron-emitting devices, before the driving voltage is applied, wherein the characteristic shift voltage is 1.05 to 1.5 times the maximum value of the driving voltage.

11. A method of manufacturing an electron generating apparatus having an electron emitting device, comprising the steps of:

forming an electron emitting portion of the electron emitting device;

reducing a partial pressure of an organic gas in which the electron emitting device is placed; and applying a voltage having a value of 1.05 to 1.5 times the maximum value of a driving voltage of the electron emitting device to the electron emitting portion, wherein said applying step is performed in an atmosphere in which the partial pressure of the organic gas has been reduced.

12. A method according to claim 11, wherein said electron emitting device has carbon or a carbon compound in the vicinity of the electron emitting portion.

13. A method according to claim 11, wherein said reducing step is performed after carbon or a carbon compound in the vicinity of the electron emitting portion has been deposited.

14. A method according to claim 11, wherein said reducing step is performed after an activation of the electron emitting portion of the electron emitting device.

15. A method according to claim 11, wherein said electron generating apparatus has a plurality of the electron emitting devices and the voltage is applied to each of the plurality of electron emitting devices.

16. A method according to claim 11, wherein the electron emitting device is a surface conduction electron emitting device.

17. A method of manufacturing an electron generating apparatus having an electron emitting device, comprising the steps of:

applying a voltage having a value of 1.05 to 1.5 times the maximum value of a driving voltage of the electron emitting device to the electron emitting device, wherein said applying step is performed in an atmosphere, in which a partial pressure of an organic gas in which the electron emitting device is placed is less than $10^{-8}$ torr.

18. A method according to claim 17, wherein said electron emitting device has carbon or a carbon compound in the vicinity of the electron emitting portion.

19. A method according to claim 17, wherein said applying step is performed after carbon or a carbon compound in the vicinity of the electron emitting portion has been deposited.

20. A method according to claim 17, wherein said applying step is performed after an activation of the electron emitting portion of the electron emitting device.

21. A method according to claim 17, wherein said electron generating apparatus has a plurality of the electron emitting devices and the voltage is applied to each of the plurality of electron emitting devices.

22. A method according to claim 17, wherein the electron emitting device is a surface conduction electron emitting device.

23. A method according to claim 11, wherein the electron-emitting device has a plurality of electron-emitting devices.

24. A method according to claim 17, wherein the electron-emitting device has a plurality of electron-emitting devices.

* * * * *

UNITED STATES PATENT AND TRADEMARK OFFICE

CERTIFICATE OF CORRECTION

PATENT NO. : 6,144,350
DATED : November 7, 2000
INVENTOR(S) : Akira Fujii et al.

It is certified that error appears in the above-identified patent and that said Letters Patent is hereby corrected as shown below:

Title page,
Item [56], FOREIGN PATENT DOCMENTS insert:
-- 8-96700 4/1996 Japan --
"428137 1/1992 Japan" should read -- 4-28137 1/1992 Japan --; and
"7094103 4/1995 Japan" should read -- 7-094103 4/1995 Japan --.

OTHER PUBLICATIONS, "electroforming" should read
-- "Electroforming --.

Column 1,
Line 30, "electrone-" should read -- electron --;
Line 31, "mitting" should read -- emitting --; and
Line 59, "convenience," should read -- convenience; --.

Column 2,
Line 14, "of cold cathode devices," should be deleted; and
Line 36, "is does" should read -- it does --.

Column 7,
Line 60, "100" delete bold.

Column 9,
Line 65, "1105" should read -- 1005 --.

Column 12,
Line 25, "etching," should read -- etching; -- ; and
Line 39, "reveals" should read -- reveal --.

Column 14,
Line 4, "method,." should read -- method; --.

Column 17,
Line 67, "Hundred pulses" should read -- A hundred pulses --.

Column 20,
Line 29, "Dx6" (second occurrence) should read -- Dy6 --; and
Line 52, "Dx6" should read -- Dy6 --.

Column 21,
Line 59, "fritgrass." should read -- fritglass. --

UNITED STATES PATENT AND TRADEMARK OFFICE

CERTIFICATE OF CORRECTION

PATENT NO. : 6,144,350
DATED : November 7, 2000
INVENTOR(S) : Akira Fujii et al.

It is certified that error appears in the above-identified patent and that said Letters Patent is hereby corrected as shown below:

Column 22,
Line 49, "made correspond for" should read -- made to correspond to --.

Column 23,
Line 35, "can" should read -- can be --; and
Line 58, "and connected" should read -- and are connected --.

Column 24,
Line 8, "2110;" should read -- 2110, --; and
Line 9, "circuits," should read -- circuits; --.

Column 27,
Line 66, "in rotary" should read -- emitting portion --.

Column 28,
Line 5, "said plurality of surface" should be deleted;
Line 6, "conduction portions of" should be deleted; and
Line 36, "larder" should read -- larger --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*